US012799838B2

(12) United States Patent
Schultz et al.

(10) Patent No.: US 12,799,838 B2
(45) Date of Patent: Nov. 17, 2026

(54) ADVANCING A TUBULAR STRING IN A WELLBORE

(71) Applicant: THRU TUBING SOLUTIONS, INC., Newcastle, OK (US)

(72) Inventors: Roger L. Schultz, Ninnekah, OK (US); Bradley J. Miller, Joliet, MT (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 19/293,728

(22) Filed: Aug. 7, 2025

(65) Prior Publication Data

US 2026/0125959 A1 May 7, 2026

Related U.S. Application Data

(63) Continuation-in-part of application No. 19/034,791, filed on Jan. 23, 2025.

(Continued)

(51) Int. Cl.
*E21B 21/08* (2006.01)
*E21B 31/00* (2006.01)

(Continued)

(52) U.S. Cl.
CPC ..... *E21B 31/005* (2013.01); *E21B 34/025* (2020.05); *E21B 45/00* (2013.01); *E21B 47/00* (2013.01)

(58) Field of Classification Search
CPC ..... E21B 31/005; E21B 31/035; E21B 45/00; E21B 21/08; E21B 21/10; E21B 21/106; E21B 7/24
See application file for complete search history.

(56) References Cited

U.S. PATENT DOCUMENTS 3,507,341 A * 4/1970 Ion ..... E21B 7/24 173/198
5,950,736 A * 9/1999 Goldstein ..... E21B 7/18 175/205

(Continued)

FOREIGN PATENT DOCUMENTS

GB 2272924 A 6/1994

OTHER PUBLICATIONS

Office Action issued Jul. 23, 2025 for U.S. Appl. No. 19/034,696, 19 pages.

(Continued)

*Primary Examiner* — Kenneth L Thompson
(74) *Attorney, Agent, or Firm* — Smith IP Services, P.C.

(57) ABSTRACT

A disclosed system can include a flow modulation system at a surface location configured to receive fluid returned from a wellbore, the flow modulation system periodically varying a flow rate of the fluid returned from the wellbore. A method of advancing a tubular string can include pumping fluid through the tubular string and into a wellbore, returning the fluid to a surface location, and flowing the returned fluid through a time-varying flow restrictor at the surface location, thereby producing fluctuations in a flow rate of the returned fluid. Another system can include a pump connected to an annulus, a flow rate of fluid pumped into the annulus at a surface location is varied to thereby produce vibration of the tubular string. Another method can include varying a flow rate of fluid pumped into an annulus as a tubular string is advanced in a well, thereby vibrating the tubular string.

38 Claims, 16 Drawing Sheets

Related U.S. Application Data

(60) Provisional application No. 63/715,818, filed on Nov. 4, 2024.

(51) Int. Cl.

| | |
|---|---|
| ***E21B 34/02*** | (2006.01) |
| ***E21B 45/00*** | (2006.01) |
| ***E21B 47/00*** | (2012.01) |

(56) References Cited

U.S. PATENT DOCUMENTS

| | | | | |
|---|---|---|---|---|
| 6,412,560 | B1 | 7/2002 | Bernat | |
| 6,910,542 | B1 * | 6/2005 | Walter | E21B 4/20 175/93 |
| 7,380,616 | B2 * | 6/2008 | Virally | E21B 21/08 175/61 |
| 8,381,817 | B2 | 2/2013 | Schultz et al. | |
| 8,439,117 | B2 | 5/2013 | Schultz et al. | |
| 8,453,745 | B2 | 6/2013 | Schultz et al. | |
| 8,517,105 | B2 | 8/2013 | Schultz et al. | |
| 8,517,106 | B2 | 8/2013 | Schultz et al. | |
| 8,517,107 | B2 | 8/2013 | Schultz et al. | |
| 8,517,108 | B2 | 8/2013 | Schultz et al. | |
| 9,140,069 | B2 | 9/2015 | Schultz et al. | |
| 9,140,070 | B2 | 9/2015 | Schultz et al. | |
| 9,194,208 | B2 | 11/2015 | Schultz et al. | |
| 9,212,522 | B2 | 12/2015 | Schultz et al. | |
| 9,316,065 | B1 | 4/2016 | Schultz et al. | |
| 9,447,647 | B2 * | 9/2016 | Lovorn | E21B 33/085 |
| 9,702,192 | B2 | 7/2017 | Wicks et al. | |
| 9,840,872 | B2 | 12/2017 | Schultz et al. | |
| 9,840,873 | B2 | 12/2017 | Schultz et al. | |
| 9,903,161 | B2 | 2/2018 | Schultz et al. | |
| 9,945,183 | B2 | 4/2018 | Schultz et al. | |
| 9,988,866 | B2 * | 6/2018 | Cotten | E21B 21/08 |
| 10,161,208 | B2 * | 12/2018 | Baudoin | E21B 7/24 |
| 10,443,310 | B2 | 10/2019 | Schultz et al. | |
| 10,513,900 | B1 | 12/2019 | Schultz et al. | |
| 10,577,867 | B2 | 3/2020 | Schultz et al. | |
| 10,871,035 | B2 | 12/2020 | Schultz et al. | |
| 11,041,352 | B2 | 6/2021 | Ferguson et al. | |
| 11,434,693 | B2 | 9/2022 | Schultz et al. | |
| 11,525,307 | B2 | 12/2022 | Schultz | |
| 11,560,756 | B2 | 1/2023 | Schultz et al. | |
| 11,753,901 | B2 | 9/2023 | Schultz et al. | |
| 11,840,925 | B2 * | 12/2023 | Pogrebinsky | E21B 47/24 |
| 2005/0103527 | A1 | 5/2005 | Church et al. | |
| 2006/0054315 | A1 | 3/2006 | Newman | |
| 2006/0101914 | A1 | 5/2006 | Mccoy | |
| 2007/0175642 | A1 | 8/2007 | Shampine et al. | |
| 2009/0223676 | A1 | 9/2009 | Eddison et al. | |
| 2009/0235656 | A1 | 9/2009 | Havinga | |
| 2012/0292116 | A1 | 11/2012 | Schultz et al. | |
| 2013/0186619 | A1 | 7/2013 | Wicks et al. | |
| 2014/0126330 | A1 | 5/2014 | Shampine et al. | |
| 2015/0159452 | A1 | 6/2015 | Miller et al. | |
| 2015/0330193 | A1 | 11/2015 | Mcarthur et al. | |
| 2016/0369583 | A1 | 12/2016 | Baudoin | |
| 2017/0292328 | A1 | 10/2017 | Swinford | |
| 2019/0356289 | A1 | 11/2019 | Cho | |
| 2020/0011146 | A1 | 1/2020 | Samuel | |
| 2020/0248548 | A1 | 8/2020 | Al-Mulhem | |
| 2022/0251911 | A1 | 8/2022 | Samuel et al. | |
| 2025/0283380 | A1 | 9/2025 | Andersen | |

OTHER PUBLICATIONS

Automated Rig Technologies Ltd., "JPI Jointed Pipe Injector," product brochure, downloaded Nov. 1, 2024, 2 pages.

Office Action issued Mar. 27, 2025 for U.S. Appl. No. 19/034,696, 20 pages.

Office Action issued Jul. 15, 2025 for U.S. Appl. No. 19/034,791, 20 pages.

Thru Tubing Solutions, "Wavforce XRV," product brochure, 1 page, dated 2021.

Thru Tubing Solutions, "XRV," product brochure, 1 page, dated 2021.

Welltec, "Datasheet Well Tractor 212 Coiled Tubing," product brochure, 1 page, dated Nov. 12, 2020.

WWT International, "WWT 312 Milling Tractor," product brochure, 1 page, downloaded Mar. 12, 2025.

Office Action issued Oct. 1, 2025 for U.S. Appl. No. 19/182,258, 70 pages.

Office Action issued Nov. 6, 2025 for U.S. Appl. No. 19/034,791, 11 pages.

Office Action issued Apr. 22, 2026 for U.S. Appl. No. 19/182,258, 30 pages.

The American Heritage Dictionary; https://www.ahdictionary.com/word/search.html?q=compliance, 3 pages.

The American Heritage Dictionary; https://www.ahdictionary.com/word/search.html?q=tool, 4 pages.

* cited by examiner

ADVANCING A TUBULAR STRING IN A WELLBORE

CROSS-REFERENCE TO RELATED APPLICATIONS

This application is a continuation-in-part of U.S. application Ser. No. 19/034,791 filed on 23 Jan. 2025, which claims the benefit of the filing date of U.S. provisional application no. 63/715,818 filed on 4 Nov. 2024. The entire disclosures of these prior applications are incorporated herein by this reference for all purposes.

BACKGROUND

This disclosure relates generally to equipment utilized and operations performed in conjunction with a subterranean well and, in an example described below, more particularly provides for displacing a tubular string in a wellbore.

It can be difficult at times to displace a tubular string through a wellbore. Friction (including differential sticking) can impede the displacement of a tubular string through a wellbore in a variety of different types of well operations (such as, milling, drilling, stimulation, testing, completion, and other types of well operations).

It will, therefore, be readily appreciated that improvements are continually needed in the art of displacing tubular strings in wellbores. The present disclosure provides such improvements, which may be used for various different purposes in well operations.

DETAILED DESCRIPTION

Figure 1:
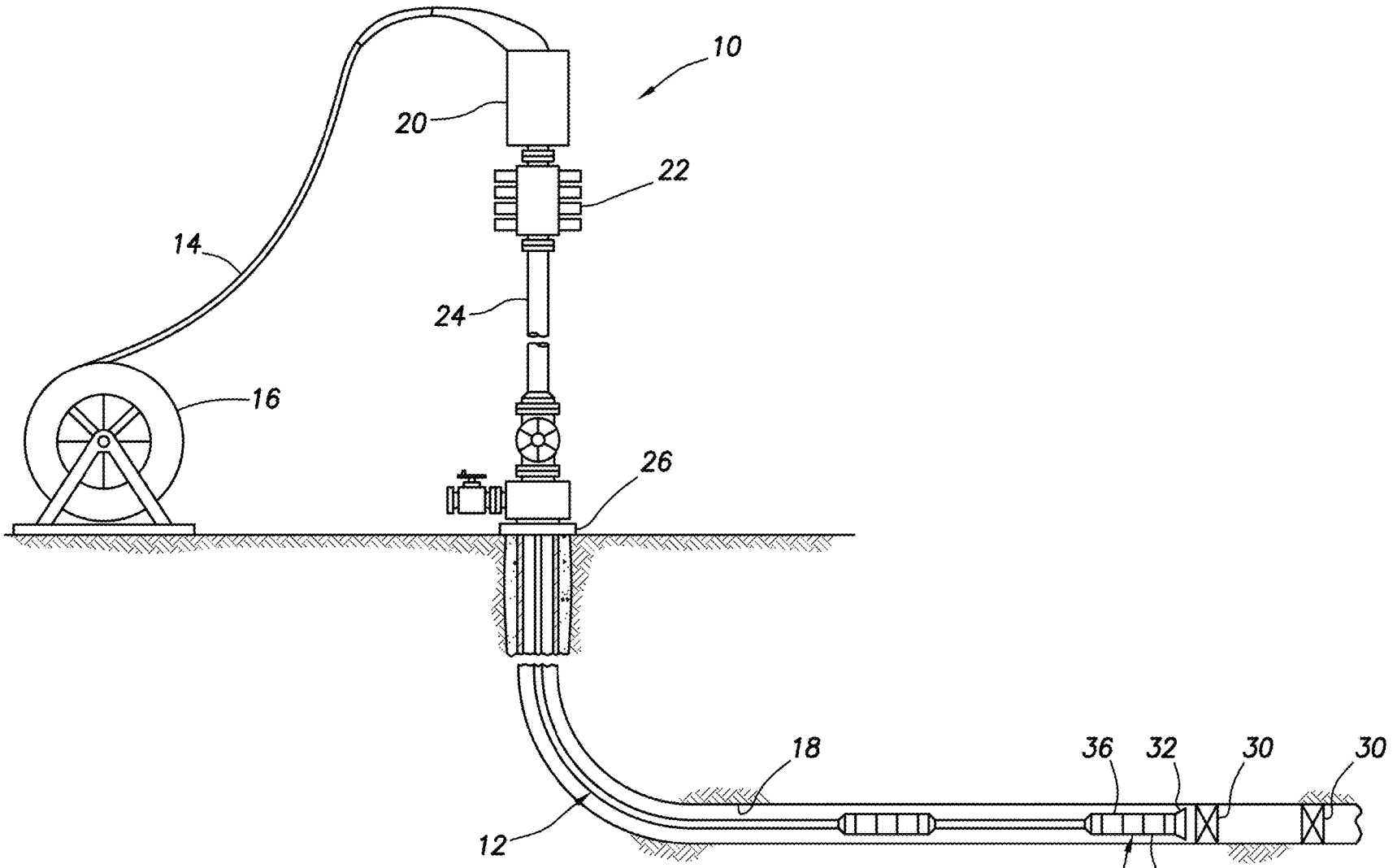
FIG. 1 is a representative partially cross-sectional view of an example of a well system and associated method which can embody principles of this disclosure.

Representatively illustrated in the accompanying drawings is a system, apparatus and associated method which can embody principles of this disclosure. However, it should be clearly understood that the system, apparatus and method are merely one example of an application of the principles of this disclosure in practice, and a wide variety of other examples are possible. Therefore, the scope of this disclosure is not limited at all to the details of the system, apparatus and method described herein and/or depicted in the drawings.

In one aspect, this disclosure describes systems, methods and apparatus for advancing a tubular workstring in a wellbore. One example use of the systems, methods and apparatus is to assist in milling frac plugs, or general cleaning or other intervention in long horizontal laterals. The methods and equipment disclosed here can in one example be described as systems, methods and apparatus for inducing axial vibration at the surface into a coiled tubing string for the purpose of aiding in advancing the coiled tubing string in a well. In other examples, the systems, methods and apparatus may be used for other purposes.

Downhole vibratory tools are often used near or at a distal end of a tubular workstring. These tools are hydraulically operated in some examples, and create vibration in the tubular workstring which breaks static friction, making it easier to move the workstring within a wellbore. As lateral lengths increase, these tools become less effective at creating vibration in the workstring near a heel of the wellbore. In some examples, the systems, methods and apparatus disclosed herein can be specifically useful in creating vibration in the portion of the workstring nearest the surface and the heel portion of the wellbore where downhole vibratory tools located near the distal end of the workstring have limited effectiveness. The systems, methods and apparatus described herein can be complementary with the use of downhole vibratory tools in some examples.

Figure 2:
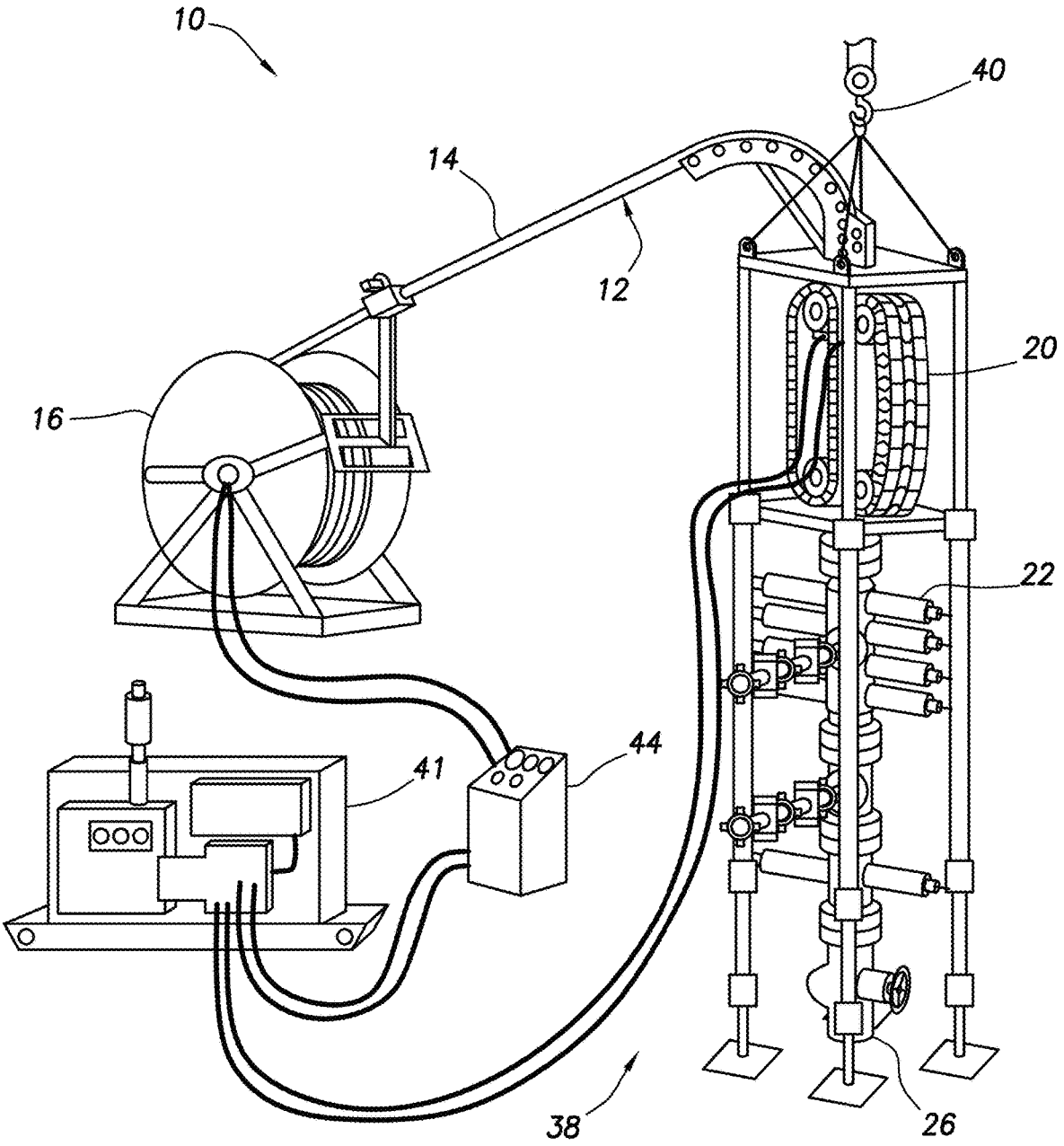
FIG. 2 is a representative perspective view of an example of surface equipment which may be used with the FIG. 1 system and method.

Example methods depicted in FIGS. 1 & 2 include variations of a coiled tubing (CT) surface equipment set up. In these examples, the coiled tubing is stored on a reel and is "snubbed" into or out of a pressurized wellbore using an injector system which dynamically grips the coiled tubing in such a way that compressive or tensile loads on the coiled tubing can be maintained while the coiled tubing is advanced or withdrawn from the well.

Figure 3:
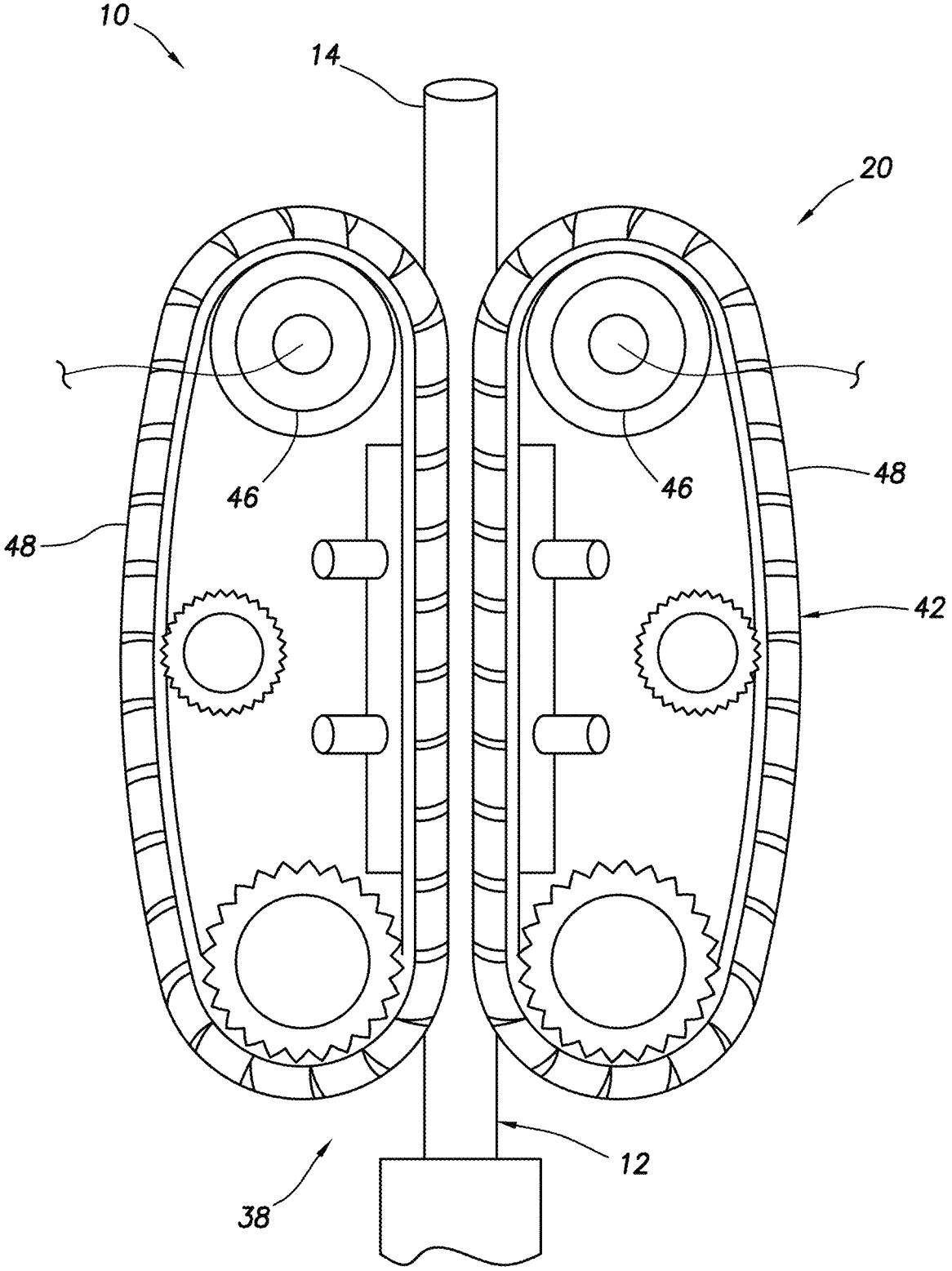
FIG. 3 is a representative side view of an example of an injector chain assembly of the surface equipment.

In these examples, the basic mechanism used to accomplish this is an injector comprising a pair of chain-type assemblies that are driven by hydraulic or electric motors. An example of this mechanism is depicted in FIG. 3. "Links" of the chains are configured such that they can be loaded against the CT in such a way that the CT is firmly gripped between the opposing chain assemblies to eliminate relative sliding motion between the chain assemblies and the CT. In this way, input from motors which drive the chain assemblies can be used to advance or withdraw the CT into or out of the well. A dynamic annular seal (such as, of the type known to those skilled in the art as a stripper seal assembly) can be used to allow the CT to move into or out of the well without leakage from the well past the CT.

In one concept disclosed herein, displacement versus time of the CT is modulated by manipulating inputs to the injector assembly to create axial vibration of the CT, which enhances the ability to move the CT in the wellbore. For example, if hydraulic motors are used to drive the injector chain assemblies, the flow versus time profile of the fluid supply to the drive motors can be controlled to produce a desired CT motion. If the CT motion is controlled appropriately, an oscillating stress wave can be induced in the CT which travels down the CT, thereby helping to break static friction between the CT and the casing or wellbore. Examples of some possible motion profiles are shown in FIGS. 4A-C, 5A-C & 6A-C.

Figure 4A:
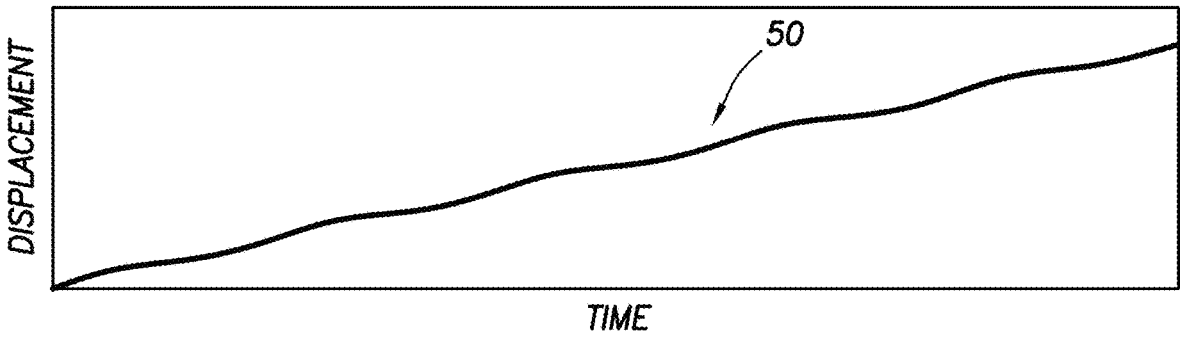
FIGS. 4A-C are representative graphs of displacement, velocity and axial acceleration over time for a first example of axial vibration of a tubular string in the system and method.
Figure 4B:
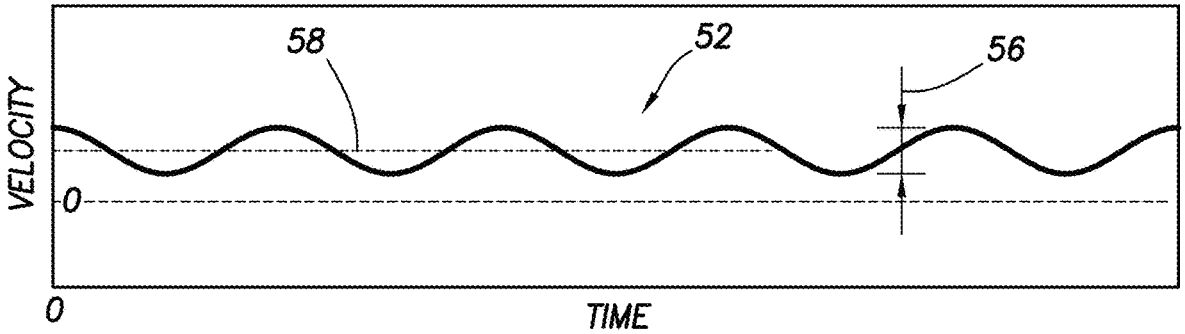
Figure 4C:
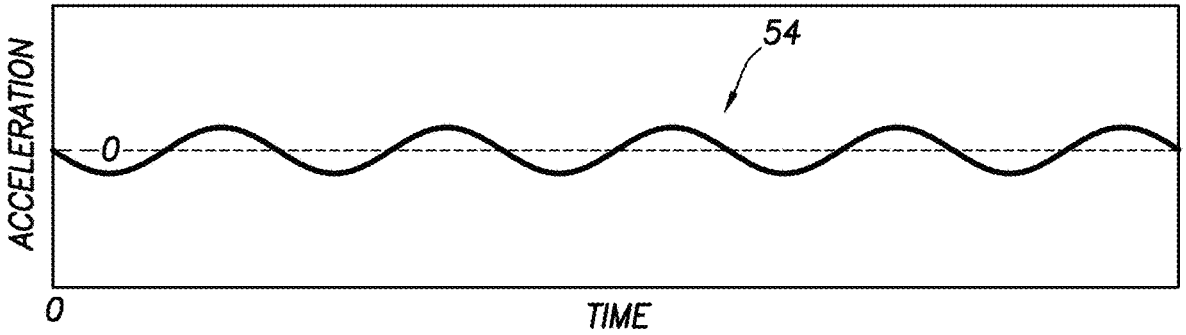

FIGS. 4A-C depict graphs of displacement, velocity and axial acceleration curves for an example of relatively constant average input speed combined with sinusoidal speed fluctuation. The average input speed magnitude is greater than half the peak-to-peak sinusoidal speed fluctuation, so there is no velocity or displacement reversal (e.g., negative velocity or displacement decrease).

In this example, the coiled tubing is continuously advanced into the wellbore. In other examples, the coiled tubing may be retrieved from the wellbore in a similar manner.

Thus, in the FIGS. 4A-C example using a relatively constant average speed combined with a sinusoidal variation in speed, the average speed component is greater than half of the peak-to-peak amplitude of the sinusoidal component. This causes the CT to always advance into the well, without ever reversing direction or velocity. Acceleration is created in both axial directions.

Figure 5A:
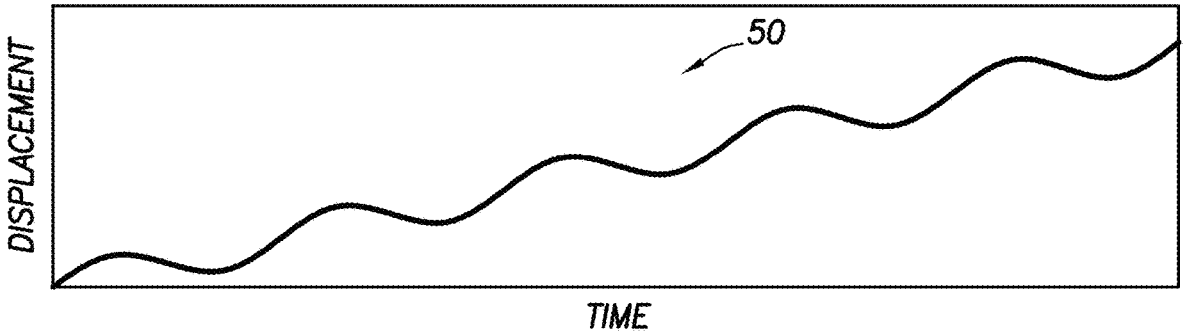
FIGS. 5A-C are representative graphs of displacement, velocity and axial acceleration over time for a second example of axial vibration of a tubular string in the system and method.
Figure 5B:
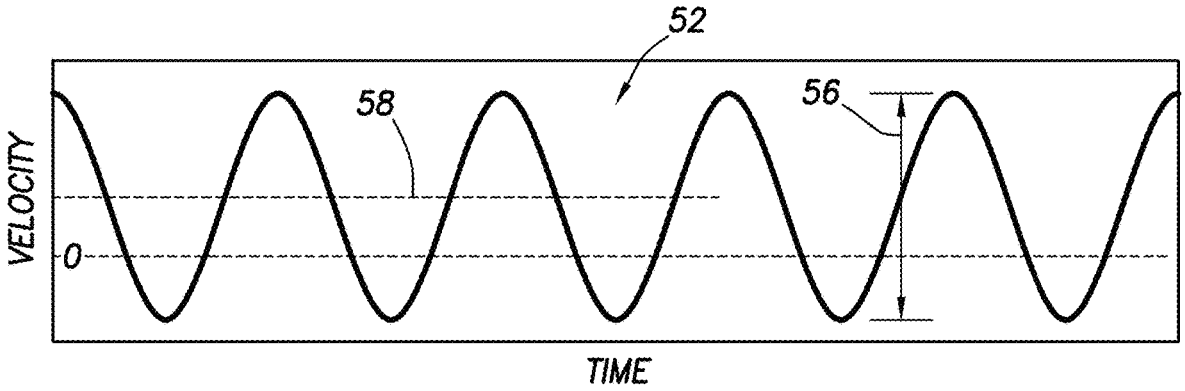
Figure 5C:
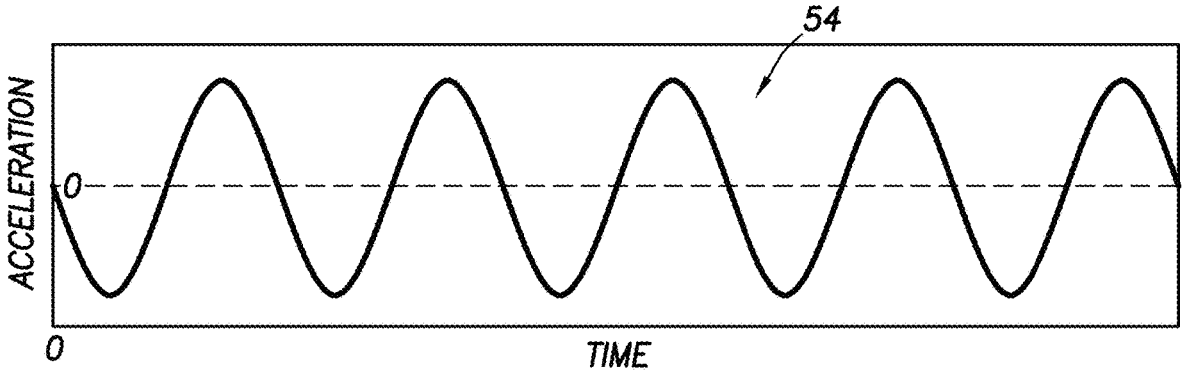

FIGS. 5A-C depict graphs of displacement, velocity and axial acceleration curves for another example in which relatively constant average input speed is combined with sinusoidal speed fluctuation. However, in this example, the average speed is less than half the peak-to-peak sinusoidal speed component, resulting in velocity and displacement reversal. This causes the CT to reverse direction (e.g., a slope of the displacement curve is periodically negative) and the velocity alternates between positive and negative, as the coiled tubing is advanced into the wellbore. Acceleration is created in both axial directions.

Figure 6A:
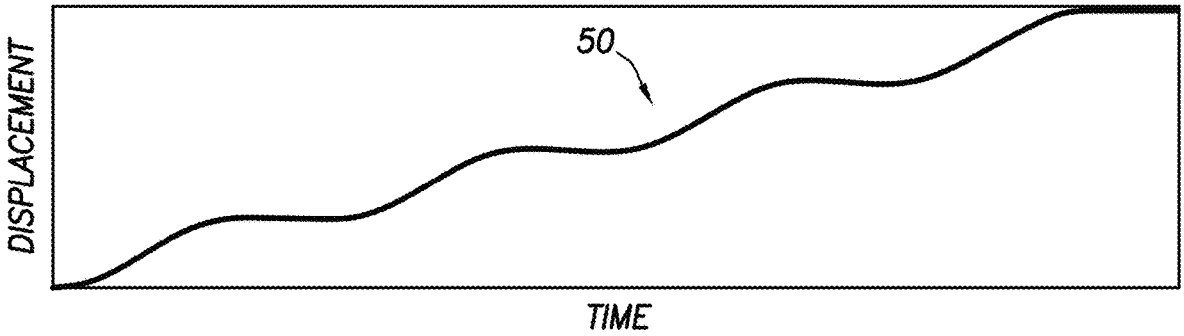
FIGS. 6A-C are representative graphs of displacement, velocity and axial acceleration over time for a third example of axial vibration of a tubular string in the system and method.
Figure 6B:
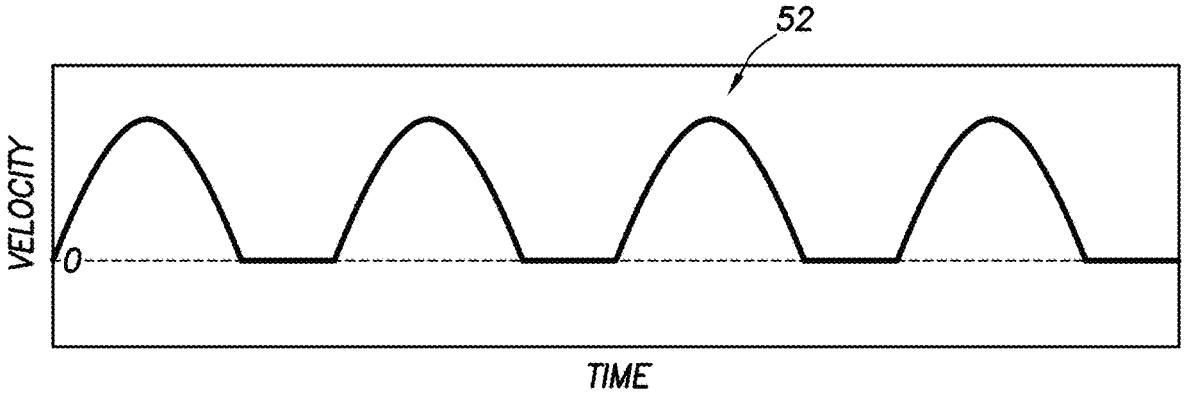
Figure 6C:
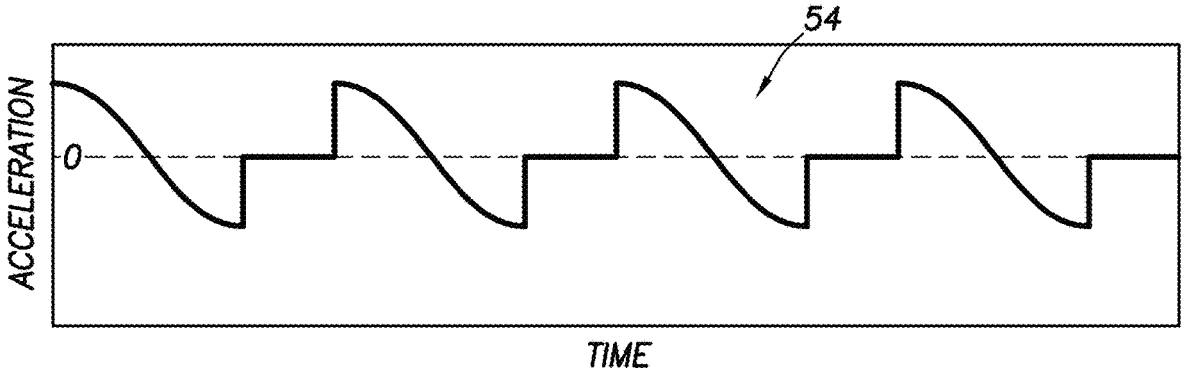

FIGS. 6A-C depict graphs of representative examples of displacement, velocity and acceleration curves when "stop and go" displacement is imparted to the coiled tubing. In this example, the velocity is increased from zero to a positive value, and then decreased back to zero for a brief period. This pattern is repeated as the coiled tubing is advanced in the wellbore. It should be noted that, even if in other examples the displacement speed is only changed (for example, decreased, but not decreased to zero), there will be a resulting axial acceleration imparted to the coiled tubing.

The displacement profile can be selected to maximize the coiled tubing vibration. For example, the duty cycle, ramp-up speed/profile, ramp-down speed/profile and frequency, or combination of frequencies, for the coiled tubing displacement can be selected for maximum effectiveness. Additionally, an adaptive control system can be employed which automatically determines, changes and optimizes the displacement profile for maximum effectiveness at any given point in time based on, for example, wellbore parameters (such as, diameter, formation type, well fluids, temperature, etc.) and operational parameters (such as, coiled tubing size, bottom hole assembly characteristics, insertion length, etc.).

The concepts described herein can be applied to any drive system used to displace coiled tubing. These concepts can also be applied to the drive system in a snubbing unit of the type used to deploy jointed pipe. Thus, axial vibration can be imparted at the surface to any type of tubular string using the principles of this disclosure.

Figure 8:
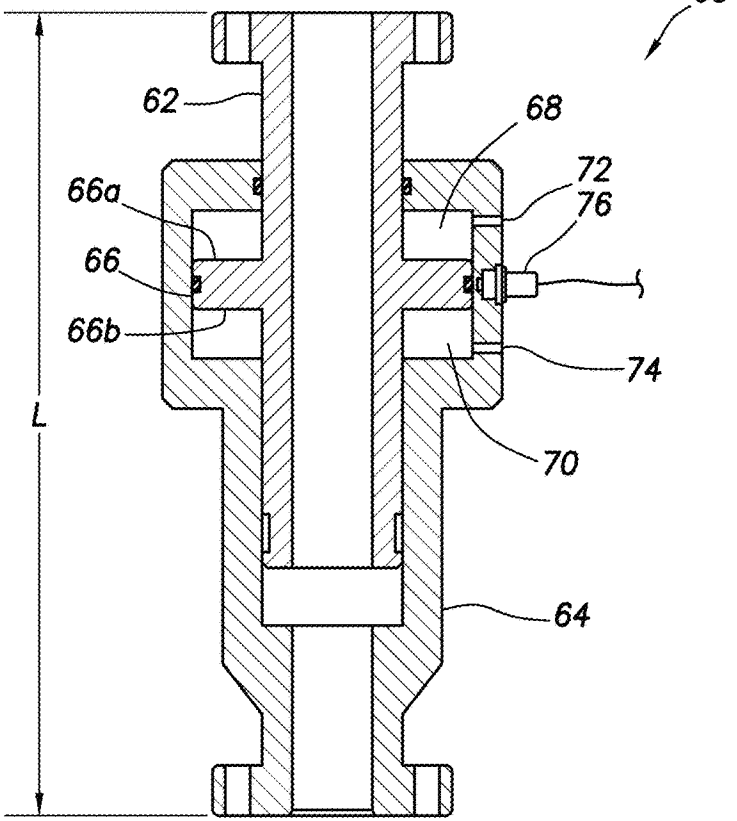
FIG. 8 is a representative cross-sectional view of an example of a vibration tool that may be used in the FIG. 7 system and method.
Figure 7:
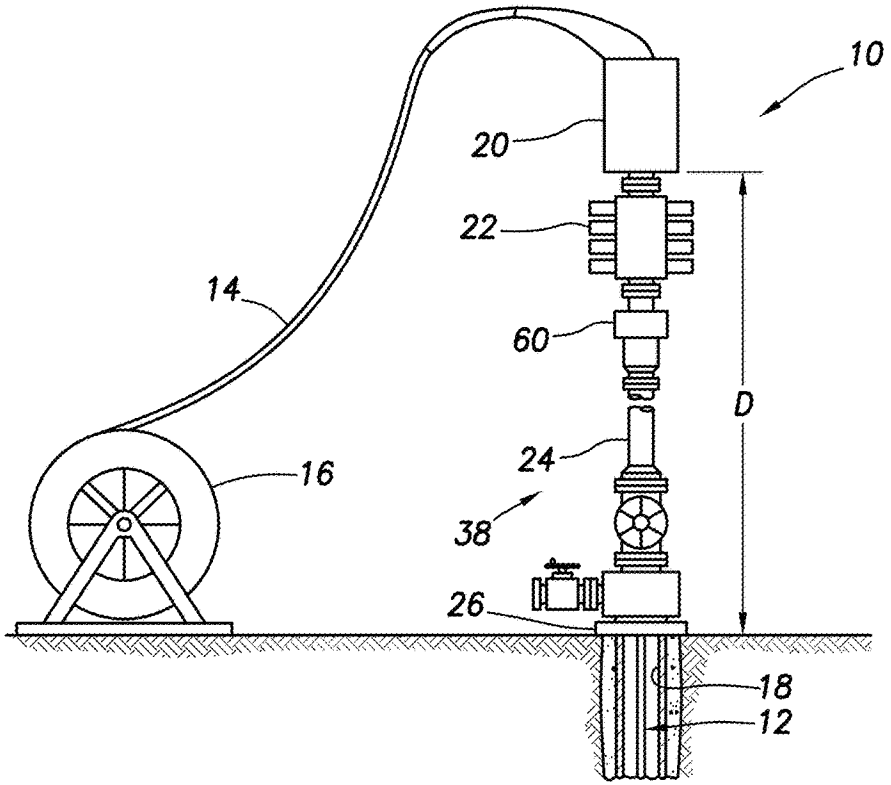
FIG. 7 is a representative partially cross-sectional view of another example of the well system and method.

In additional example methods, vibration can be imparted into the coiled tubing by displacing the injector chain assembly, or the entire injector assembly, relative to the surface or a wellhead. In FIGS. 7 & 8, an example is depicted in which an axial vibration tool is connected between the injector assembly and the wellhead. The axial vibration tool is depicted as being connected below a blowout preventer stack, but in other examples the vibration tool could be connected above the blowout preventers.

The vibration tool in this case is hydraulically actuated to create axial movement of the injector assembly by causing extension and contraction of a distance between the wellhead (or the earth's surface) and the injector assembly. Since the chain assemblies in the injector are in gripping engagement with the coiled tubing, the axial movement of the injector also causes axial movement (e.g., vibration) of the coiled tubing.

FIG. 8 depicts an example of the axial vibration tool. A hydraulic pressure source is connected to the vibration tool and is used to alternately raise and lower an inner mandrel to create movement of the injector assembly and coiled tubing. In other examples, the vibration tool could be oriented differently (e.g., so that the mandrel extends downward). Other configurations of the vibration tool can be used in which a length of the vibration tool is alternately increased and decreased.

The vibration tool can include a position sensor, which is used, for example, to monitor and limit the up and down travel of the mandrel, and to calculate velocity and acceleration of the injector assembly. Outputs of the position sensor can be used by the control system, for example, to determine amplitude and frequency of hydraulic pressure to be applied to the vibration tool.

The injector assembly is used to create net directional travel of the coiled tubing into or out of the well. The vibration tool is used in this example to create vibration in the form of alternating changes in axial displacement, velocity and acceleration of the coiled tubing or other tubular string.

Figure 9:
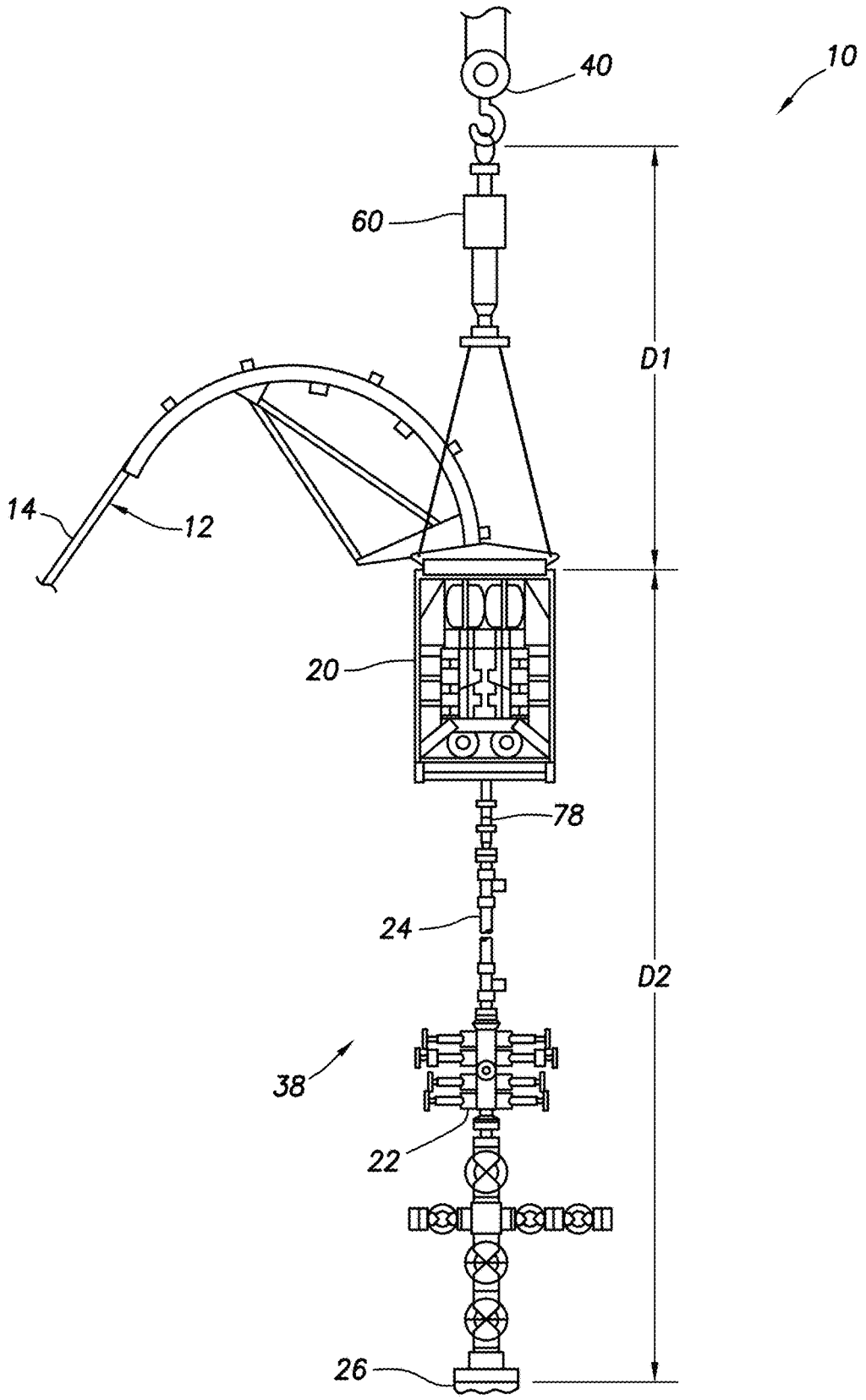
FIG. 9 is a representative side view of another example of the well system and method.

In another example method depicted in FIG. 9, a vibration tool can be used to displace an injector assembly that is suspended above the well using a crane or other support structure. A hydraulic, electric or other type of actuator or vibration tool is interposed between the support structure and the injector assembly in order to produce axial vibration of the injector assembly and the coiled tubing.

Hydraulic or electrical actuation of the actuator or vibration tool creates vertical motion of the injector assembly, thereby inducing vibration of the coiled tubing. Thus, a length between the support structure and the injector assembly is varied, which causes a length between the injector assembly and the wellhead (and between the injector assembly and the support structure) to vary. In this arrangement, a dynamic sealing sub may or may not be included in the surface lubricator assembly between the injector assembly and the wellhead to provide more freedom of axial movement.

In the FIGS. 7-9 examples, the vibration tool can comprise any type of actuation means, such as, electrostrictive, magnetostrictive, or a chemically, mechanically, electrically or hydraulically driven mechanical mechanism (such as a crank-slider mechanism) that produces appropriate reciprocation or alternating axial displacement of the coiled tubing, such that desirable vibration is imparted to the coiled tubing.

Another example method of creating vibration in coiled tubing at the surface is to passively or actively modulate a flow of fluid being pumped from the surface into the coiled tubing. Changing a speed of the fluid traveling axially through the surface equipment and coiled tubing creates a resulting change in fluid momentum and drag forces on interior surfaces of the surface equipment and coiled tubing flow passages that causes a corresponding change in loading on the surface equipment and coiled tubing. Appropriate modulation of the fluid flow can produce an oscillating loading condition that causes axial vibration of the coiled tubing at the surface.

Figure 10:
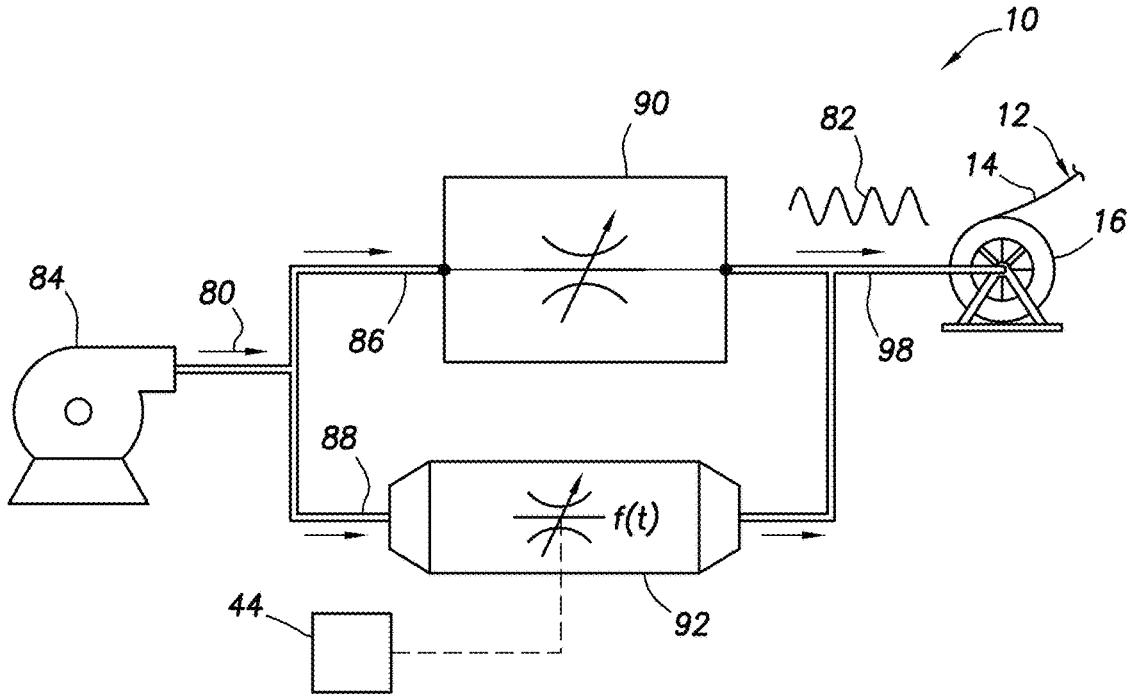
FIG. 10 is a representative schematic view of another example of the well system and method.

FIG. 10 depicts an example in which fluid is pumped from a surface supply pump, travels through parallel flow paths, and then the flow paths are re-joined downstream of the parallel flow paths. In one flow path, a relatively static, but adjustable, flow restrictor (such as an adjustable choke) is connected. In this example, the adjustable flow restrictor in the first parallel flow path provides a means to bypass as much or as little of the supplied fluid flow from going through a modulation device in the second parallel flow path.

The modulation device can comprise a time-varying flow restrictor connected in the second parallel flow path. The flow resistance of this device changes with time. The time-varying flow restrictor may in some examples partially or completely interrupt flow passing through the flow restrictor. The flow restrictor can comprise a self-governing device similar to vibratory tools, such as, the XRV™ marketed by Thru Tubing Solutions, Inc. of Newcastle, Oklahoma USA, the AGITATOR™ marketed by National Oilwell Varco of Houston, Texas USA, or the HYDROPULL™ marketed by Tempress Technologies, Inc. of Renton, Washington, USA. The time-varying flow restrictor may comprise other types of devices in other examples.

The time-varying flow restrictor can alternatively be an actively controlled device that serves as a variable flow restrictor that responds to a control signal that can be controlled by any means (such as a microprocessor, programmable logic controller, etc.). Any type of valve or flow restrictor that responds to a control signal could be used with an appropriate control system to modulate fluid flow.

Fluid pulsation (variations of fluid flow rate) in the surface flow can be used to create vibration in the CT at the surface. Fluid pulsation creates changes in fluid momentum and internal drag forces, thereby creating vibration. A "spring" sub (see FIGS. 13-15) can be used between the wellhead and injector to enhance the vibration. Pulse generation devices can include the XRV™ mentioned above or other downhole vibratory tool concepts, mechanically, electrically or hydraulically driven valves, or any other type of time-variable flow restrictor.

Figure 11:
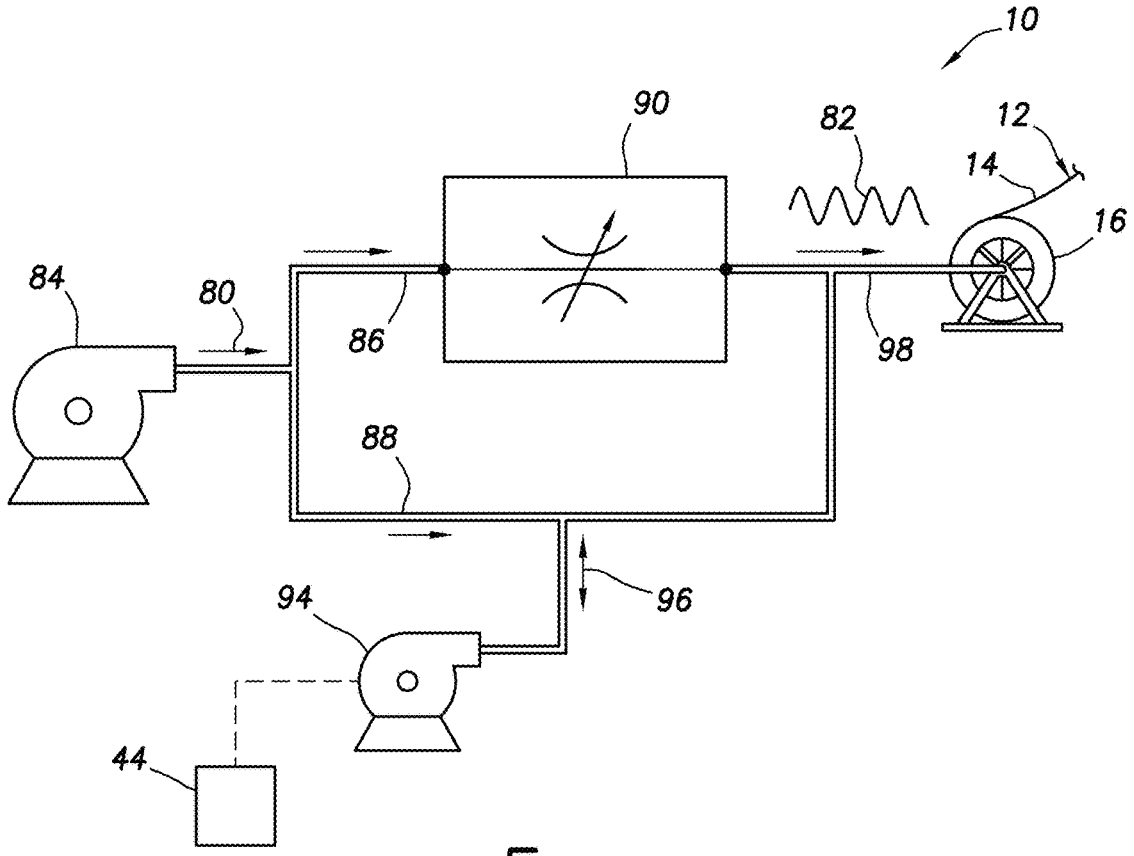
FIG. 11 is a representative schematic view of another example of the well system and method.

FIG. 11 depicts an example, similar in some respects to the FIG. 10 example, with the exception that the flow modulation device is an active pulse generation device. In this case, fluid pulsation is created by actively adding and/or removing fluid from the fluid flow being supplied to the coiled tubing.

In one example, a positive displacement piston device, such as, a modified piston-type pump can be used. In this example, a discharge valve of the pump is removed. This creates a condition where the piston(s) in the pump is always in fluid communication with the fluid supply to the coiled tubing. As the piston(s) moves to the top of its stroke a positive pressure pulse is introduced to the supply line. As the piston(s) moves to the bottom of its stroke a negative pressure pulse is created in the supply line.

Other types of flow modulation devices or pumps may be used in other examples. Operating parameters of the flow modulation device or pump can be varied as appropriate by the control system.

Figure 12:
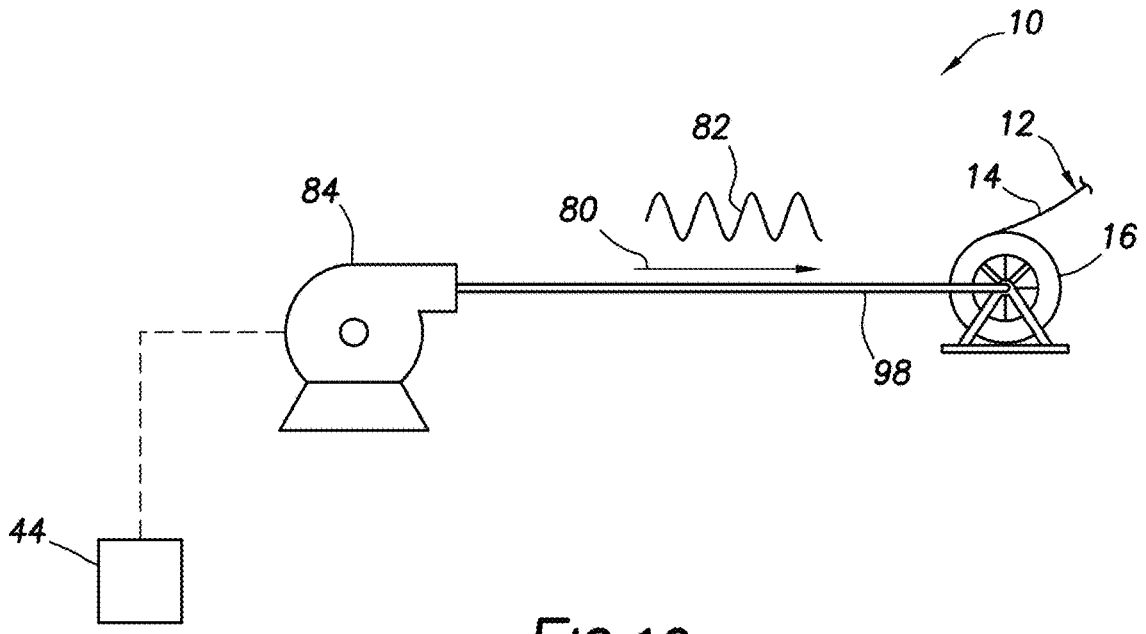
FIG. 12 is a representative schematic view of another example of the well system and method.

FIG. 12 depicts another example in which a surface pump used to supply fluid to the coiled tubing is modified to produce significant pulsation in the pump output. One possible modification is to remove or disable the discharge valve on at least one cylinder of the pump. As the piston moves toward a top of its stroke a positive pressure pulse is created. As the piston moves toward a bottom of its stroke a negative pressure pulse is created. In this way, as the pump operates, a continuous series of pressure pulses are produced in the supply flow from the pump. Operating parameters of the pump can be varied as appropriate by the control system.

Figure 13:
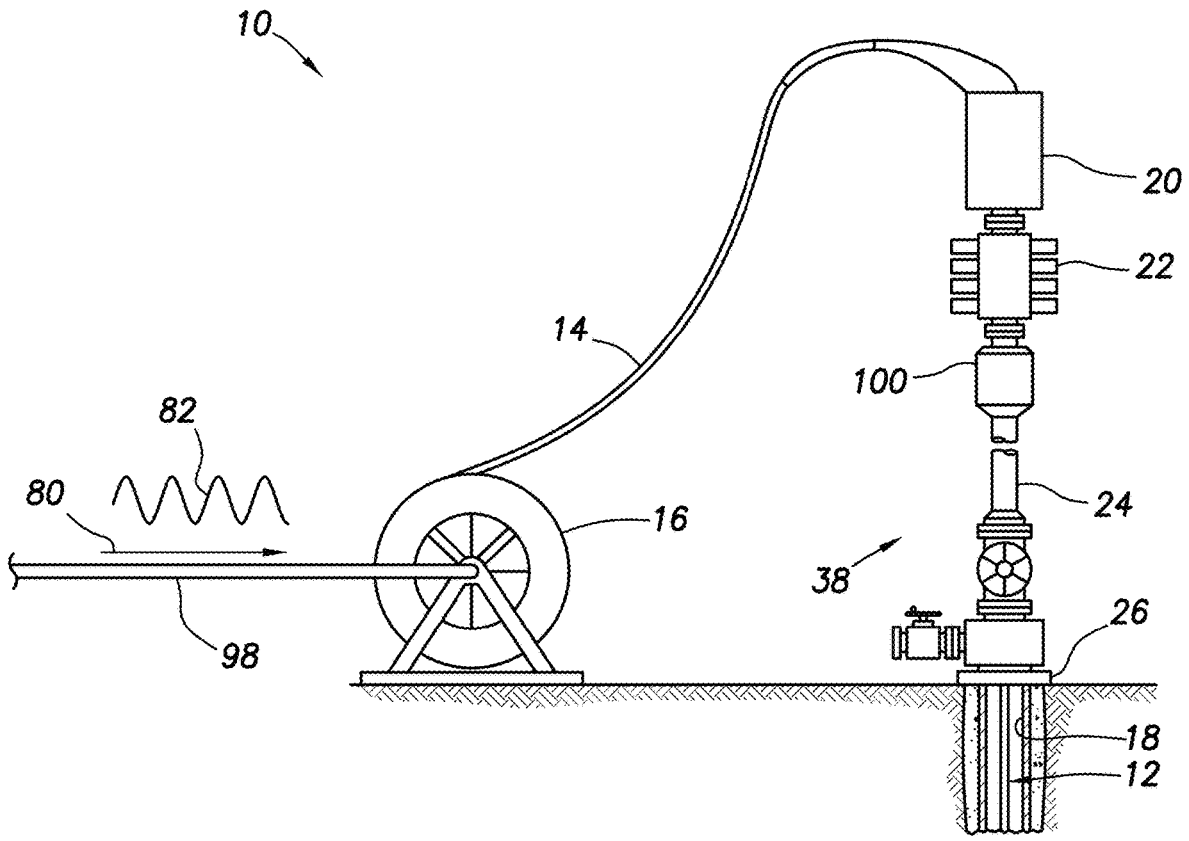
FIG. 13 is a representative partially cross-sectional view of another example of the well system and method.

In an example depicted in FIG. 13, a vibration enhancing tool is connected between the injector assembly and the wellhead. In this example, the vibrations produced using the fluid pulsation or modulation of the FIGS. 10-12 examples is enhanced by use of the tool. Although the vibration enhancing tool is depicted in FIG. 13 as being connected between the blowout preventer stack and the wellhead, the tool may be connected in other positions in other examples.

Figure 14:
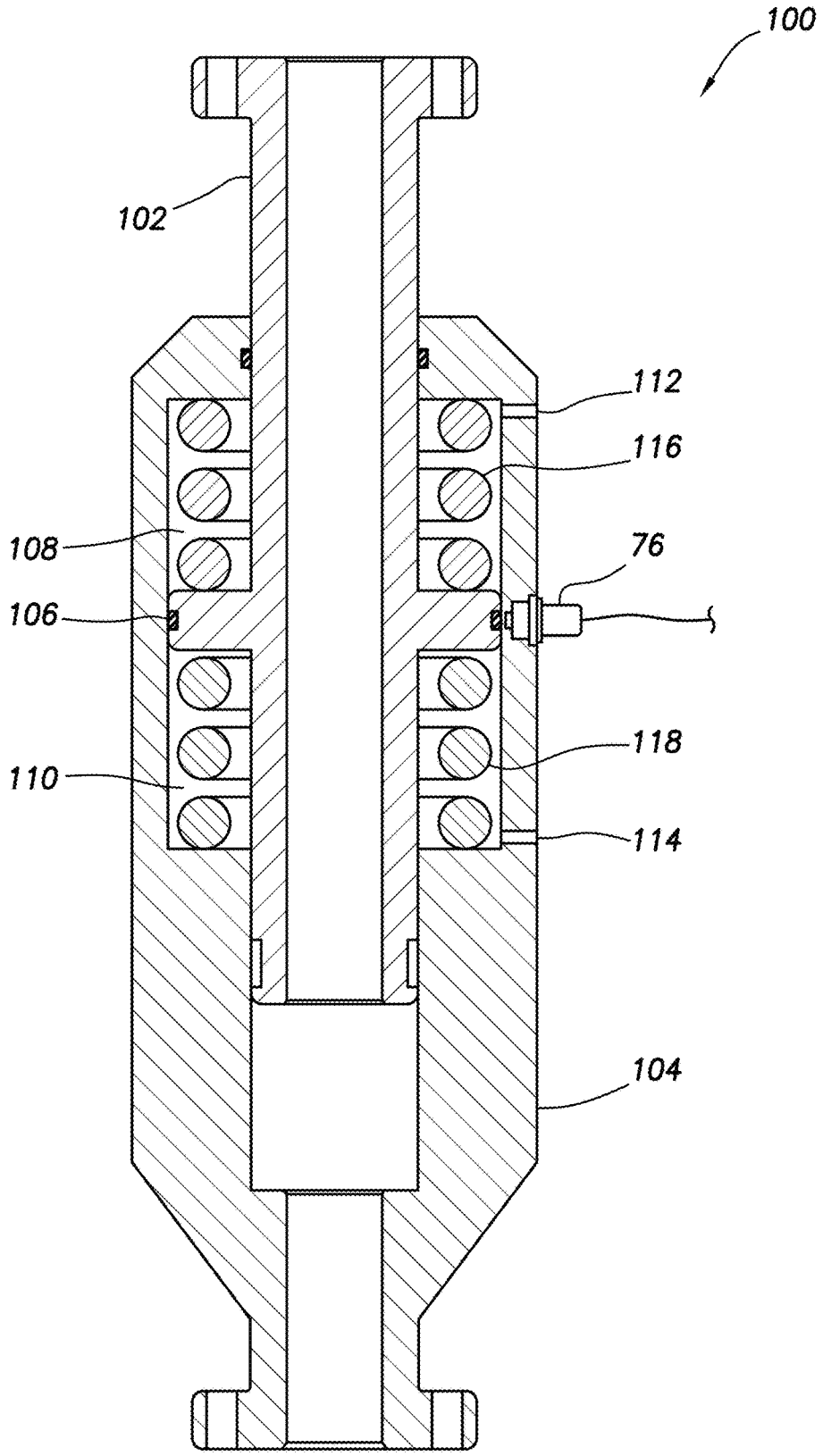
FIG. 14 is a representative cross-sectional view of an example of a vibration enhancing tool that may be used with the well system and method.

In an example depicted in FIG. 14, a mechanically compliant spring sub provides for increased relative axial movement between the wellhead and the injector, which amplifies and enhances the generated axial vibration. The spring can be mechanical, electrical, hydraulic, pneumatic, magnetic or any other suitable spring component.

Figure 15:
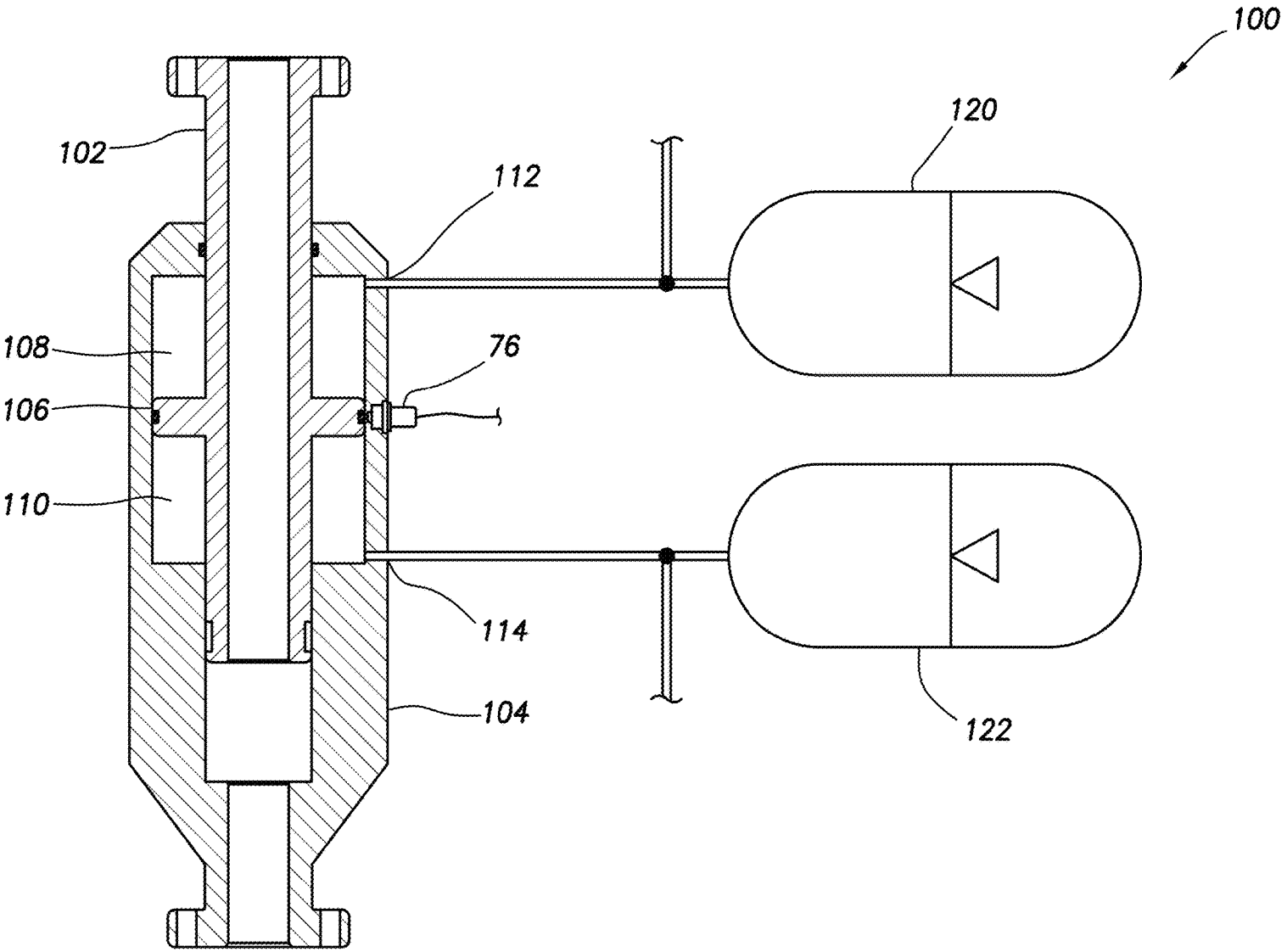
FIG. 15 is a representative cross-sectional and schematic view of another example of the vibration enhancing tool.

In an example depicted in FIG. 15, the vibration enhancing tool contains hydraulic fluid on either side of an internal piston area. Fluid on one side of the piston is in fluid communication with a hydraulic accumulator and an adjustable pressure source. Similarly, fluid on the other side of the operating area is in fluid communication with a second hydraulic accumulator and a second adjustable pressure source.

A position sensor can be included, which makes it possible to determine and adjust the tool within a desired operating range. By independently adjusting the pressure on both sides of the piston area, the spring-rate for the tool can be controlled, as well as the relative positions of the tool components.

For example, the effective spring rate for the tool can be adjusted by raising the pressure on both sides of the piston area. This makes it possible to "tune"the spring rate for optimal vibration production.

As another example, a mechanical operating range of the tool can be geometrically centered or otherwise located as desired for varying loads applied to the tool by adjusting the differential pressure across the piston area (e.g., to balance average loading of the tool). This is useful, for example, for varying loads on the injector related to the amount of coiled tubing in the well, frictional loading, well pressures and many other factors.

The methods and systems disclosed herein can be used in conjunction with the use of one or more downhole vibratory tools and/or during plug milling operations. The methods and systems disclosed herein may be used to free a tubular string that is stuck in a well.

The surface vibration inducing system may be turned off/deactivated or on/activated one or more times during a well operation.

Operation of the surface vibration inducing system may be delayed until a portion of the CT run into the well has been completed (such as, a predetermined length of a tubular string has been deployed into a wellbore), or until well friction causes the deployment speed to decrease below a predetermined level.

Operating characteristics/parameters of the surface vibration inducing system may be varied during a job as needed to achieve or maintain optimal vibration in the tubular string. The surface vibration inducing system may be adjusted in response to observing an effectiveness of the surface vibration inducing system at helping advance the tubular string into or out of the wellbore. An adaptive control system (e.g., comprising machine learning, a neural network, an artificial intelligence, etc.) may be used to continuously calculate and implement optimal settings for the surface vibration inducing system.

Each of the specific methods disclosed herein can be applied to jointed pipe snubbing systems. In one example, a style of snubbing unit known as a jointed pipe injector (JPI) of the type marketed by Automated Rig Technologies Ltd. of Alberta, Canada may be used.

In the examples described herein, a method, system and apparatus for advancing a tubular string in a wellbore includes the tubular string being axially vibrated at surface. The tubular string may comprise continuous coiled tubing and/or jointed pipe.

One or more downhole vibratory tools may be connected in the tubular string. Plug milling operations may be performed while or after the tubular string is vibrated at the surface.

The surface vibration system may be turned off or on one or more times during a well operation. The surface vibration system may not be activated until a predetermined portion of the CT is run into the well. The surface vibration system may not be activated until friction between the tubular string and the wellbore causes the running in hole (RIH) speed or displacement speed to drop below or near a desirable level.

The surface vibration system may be used to free a tubular that is stuck in the well. The operating characteristics of the surface vibration system may be varied to create optimal vibration in the CT.

Operation of the surface vibration system may be varied in response to observing the effectiveness of the surface vibration system at helping advance the tubular string in the well. An adaptive control system may be used to continuously calculate and implement optimal settings for the surface vibration system.

In some examples described herein, a method, system and apparatus for advancing a tubular string in a wellbore can include the tubular string being stored on a reel and "snubbed" into or out of a pressurized wellbore using an injector assembly which dynamically grips the tubular string in such a way that compressive or tensile loads on the tubular string can be maintained while the tubular string is either advanced, or withdrawn from the well.

Displacement versus time of the tubular string may be manipulated by manipulating inputs to an injector assembly to create axial vibration of the tubular string. The inputs may include hydraulic or electrical power inputs to motors of the injector assembly.

In some examples, vibration may be imparted to the tubular string by physically moving an injector chain assembly, or an entire injector assembly. A vibration tool may be installed in surface equipment between a fixed wellhead and an injector assembly.

A hydraulic or other type of actuator may be connected between a support structure and an injector assembly. The actuator or vibration tool may comprise a chemically, mechanically, electrically or hydraulically driven mechanical mechanism (such and a crank-slider mechanism).

The vibration may be created in the tubular string at the surface by passively or actively modulating a flow of a fluid pumped from the surface into the tubular string. Changing a speed or flow rate of the fluid traveling axially through surface plumbing and the tubular string can produce a change in fluid momentum and drag forces on an interior of the fluid passageways that causes a corresponding change in loading on the surface equipment and tubular string. The fluid flow may be modulated so that an oscillating loading condition is created that causes axial vibration of the tubular string at the surface.

In some examples, a mechanically compliant spring sub or vibration enhancing tool may be connected in a surface assembly between a fixed wellhead and an injector assembly. The vibration enhancing tool may contain hydraulic fluid on either side of an internal piston area. An effective spring rate for the vibration enhancing tool may be adjusted by varying pressure on opposite sides of the piston area. A mechanical operating range of the tool may be geometrically centered for varying loads on the tool by adjusting a differential pressure across the piston area to balance average loading on the tool.

Referring specifically now to FIG. 1, a partially cross-sectional view of an example of a system 10 and method for axially vibrating a tubular string 12 at a surface location is representatively illustrated. In this example, the tubular string 12 comprises substantially continuous coiled tubing 14 of the type which is stored on a reel 16 at the surface, but in other examples the tubular string could comprise jointed pipe (such as, drill pipe, production tubing, casing, liner, etc.).

The tubular string 12 is advanced into and out of a wellbore 18 using an injector assembly 20. In this example, the injector assembly 20 is connected above a blowout preventer stack 22 and a lubricator 24 secured to a wellhead 26. Other surface equipment, other combinations of equipment, and other arrangements or configurations of the equipment may be used in other examples.

As depicted in FIG. 1, a bottom hole assembly 28 is connected at a distal end of the tubular string 12. In this example, the tubular string 12 with the bottom hole assembly 28 is used to mill or drill out one or more frac plugs 30 set in the wellbore 18. The plugs 30 are set in a generally horizontal section of the wellbore 18.

To cut into, mill or drill through the plugs 30, the bottom hole assembly 28 includes a mill or drill bit 32 and a fluid motor 34 for rotating the bit. Note that it is not necessary in keeping with the principles of this disclosure for a tubular string deployed in a wellbore to include a bottom hole assembly, for the bottom hole assembly to be used to remove a plug, or for the bottom hole assembly to include a bit or fluid motor.

As discussed above, it can be difficult to deploy a tubular string a substantial distance into a horizontal or highly deviated wellbore, due to friction between the tubular string and the wellbore in the horizontal or highly deviated section. To assist in mitigating this increased friction in the generally horizontal section of the wellbore 18 in the FIG. 1 example, the bottom hole assembly 28 includes a vibration tool 36 to produce vibrations in the bottom hole assembly and tubular string 12.

The vibration tool 36 may produce the vibrations in response to flow of fluid through the vibration tool, and may be activated (and/or deactivated) after the bottom hole assembly 28 is deployed into the wellbore 18. Examples of suitable vibration tools include, but are not limited to, those described in U.S. Pat. No. 10,724,318 and U.S. application Ser. No. 18/664,555 filed on 15 May 2024, the entire disclosures of which are incorporated herein by this reference for all purposes.

Alternatively, or in addition, the surface equipment of the system 10 may include features (described more fully below) that produce axial vibration of the tubular string 12 at the surface. For example, the injector assembly 20 may be operated in a manner that produces the axial vibrations, or the injector assembly may itself be vibrated to thereby vibrate the tubular string 12. Alternatively, fluid flow into the tubular string 12 at the surface may be varied to thereby produce the vibrations in the tubular string 12.

The vibrations produced in the tubular string 12 at the surface location may be initiated before, after, or regardless of whether, vibrations are produced in the tubular string by a vibration tool downhole. The vibrations produced in the tubular string 12 at the surface location may be initiated after the tubular string 12 has been deployed a certain distance into the wellbore 18 (or into the generally horizontal section of the wellbore), or after a displacement speed of the tubular string through the wellbore has decreased below a desired level. In some examples (such as, when a stuck tubular is being retrieved from a wellbore), there may be no particular relationship between deployment of a tubular string into a horizontal or highly deviated section of a wellbore and activation of the surface equipment to impart vibrations to the tubular string.

Referring additionally now to FIG. 2, a representative perspective view of an example of surface equipment 38 which may be used with the FIG. 1 system 10 and method is depicted. For convenience, the FIG. 2 surface equipment 38 is described below as it may be used with the FIG. 1 system 10 and method, but the FIG. 2 surface equipment may be used with other systems and methods in other examples.

In the FIG. 2 example, the injector assembly 20 is supported by means of a support structure 40 (such as, a crane, draw works, etc.). A prime mover 41 (for example, including a hydraulic pump) is used to supply hydraulic power input to operate the reel 16 and the injector assembly 20. A control system 44 controls application of hydraulic pressure and fluid flow to the reel 16 and the injector assembly 20.

In one example, the control system 44 can vary the hydraulic power input to the injector assembly 20 in such a manner that axial vibration is imparted to the tubular string 12 in the injector assembly. In addition, the control system 44 can initiate the vibrations at certain points in time, and can optimize the production of the vibrations to achieve a desired level of vibration of the tubular string 12 downhole. The control system 44 can include artificial intelligence (such as, machine learning, neural networks, genetic algorithms, etc.) capable of determining whether and how the tubular string 12 should be vibrated to achieve a desired result (such as, desired displacement of the tubular string through the wellbore 18).

Referring additionally now to FIG. 3, a representative side view of an example of an injector chain assembly 42 of the injector assembly 20 is depicted. In this example, the injector chain assembly 42 includes two continuous chains 48 configured to grip opposite sides of the tubular string 12.

The injector chain assembly 42 also includes motors 46 for driving the chains 48. The motors 46 may be hydraulic, electric or another type of motor.

The motors 46 can be operated in response to hydraulic or electrical power input controlled by the control system 44. The hydraulic or electrical input to the motors 46 can be varied to produce axial vibration of the tubular string 12 in the injector assembly 20.

Referring additionally now to FIGS. 4A-C, representative graphs of axial displacement 50, velocity 52 and acceleration 54 over time for an example of axial vibration of the tubular string 12 are depicted. In this example, the tubular string 12 is continuously displaced into the wellbore 18, so that the tubular string does not reverse direction, but the velocity 52 is varied.

As depicted in FIG. 4B, the velocity 52 is not negative at any point. A peak-to-peak amplitude 56 of the velocity 52 curve is less than twice an average 58 of the velocity. Thus, a slope of the displacement 50 curve is positive at all times (see FIG. 4A). However, the acceleration 54 is periodically negative (see FIG. 4C), since the velocity 52 periodically decreases.

Referring additionally now to FIGS. 5A-C, representative graphs of axial displacement 50, velocity 52 and acceleration 54 over time for another example of axial vibration of the tubular string 12 are depicted. In this example, the tubular string 12 is displaced gradually into the wellbore 18, but is periodically displaced out of the wellbore. The tubular string 12 reverses direction periodically as the velocity 52 is varied.

As depicted in FIG. 5B, the velocity 52 is periodically negative. The peak-to-peak amplitude 56 of the velocity 52 curve is greater than twice the average 58 of the velocity. Thus, the slope of the displacement 50 curve is periodically negative (see FIG. 5A), although it is positive a majority of the time, and so the tubular string 12 is gradually advanced into the wellbore 18. As depicted in FIG. 5C, the acceleration 54 is periodically negative, since the velocity 52 periodically decreases.

Referring additionally now to FIGS. 6A-C, representative graphs of axial displacement 50, velocity 52 and acceleration 54 over time for another example of axial vibration of the tubular string 12 are depicted. In this example, the tubular string 12 does not reverse direction, but is not continuously displaced into the wellbore 18.

As depicted in FIG. 6B, the velocity 52 is not negative at any point. Instead, the velocity 52 periodically increases, then decreases, and then is zero. A slope of the displacement 50 curve is positive, except when the velocity 52 is zero (see FIG. 6A). The acceleration 54 is periodically negative (see FIG. 6C), since the velocity 52 periodically decreases.

Referring additionally now to FIG. 7, a representative partially cross-sectional view of another example of the well system 10 and method is depicted. In this example, the injector assembly 20 is vibrated to thereby impart vibration to the tubular string 12.

As depicted in FIG. 7, a vibration tool 60 is connected between the injector assembly 20 and the wellhead 26. In this example, the vibration tool 60 is connected between the blowout preventer stack 22 and the lubricator 24, but the vibration tool can be connected in other positions in other examples.

Operation of the vibration tool 60 produces fluctuating, periodic changes in a distance D between the injector assembly 20 and the wellhead 26. Since the vibration tool 60 is connected below the blowout preventer stack 22 in this example, a distance between the injector assembly 20 and the blowout preventer stack does not change when the vibration tool is operated. However, if the vibration tool 60 is connected between the injector assembly 20 and the blowout preventer stack 22, then a distance between the injector assembly and the blowout preventer stack will periodically change as the vibration tool is operated.

Referring additionally now to FIG. 8, a representative cross-sectional view of an example of the vibration tool 60 is depicted. In this example, the vibration tool 60 includes an inner mandrel 62 slidingly and sealingly received in an outer housing 64.

A radially enlarged piston 66 is formed on the inner mandrel 62. The piston 66 has opposing piston areas 66*a, b*. Annular chambers 68, 70 are formed radially between the inner mandrel 62 and the outer housing 64 on opposite sides of the piston 66.

Ports 72, 74 in communication with the respective chambers 68, 70 can be connected to a source of hydraulic pressure (such as, the FIG. 2 prime mover 41), and the hydraulic pressure applied to each chamber can be controlled by the control system 44. A proximity or position sensor 76 can be used to detect a position of the piston 66, and can be connected to the control system 44 for controlling operation of the vibration tool 60.

The pressures applied to the chambers 68, 70 can be varied to produce fluctuating, periodic changes in a length L of the vibration tool 60. In addition, the pressures in the chambers 68, 70 can be adjusted to compensate for loads applied to the tool 60, for example, so that the piston 66 is "centered" in the chambers 68, 70 while the tool produces axial vibration of the injector assembly 20 and the tubular string 12.

Referring additionally now to FIG. 9, a representative side view of another example of the well system 10 and method is depicted. In this example, the vibration tool 60 is connected between the injector assembly 20 and the support structure 40 which suspends the injector assembly above the wellhead 26.

As the vibration tool 60 is operated to produce axial vibrations, a distance D1 between the injector assembly 20 and the support structure 40 changes. In addition, a distance D2 between the injector assembly 20 and the wellhead 26 changes, thereby producing axial vibrations in the tubular string 12. A slip joint or dynamic sealing sub 78 (possibly combined with a stuffing box annular seal) can be used to permit relatively unrestricted axial displacement of the injector assembly 20 relative to the wellhead 26.

Referring additionally now to FIG. 10, a representative schematic view of another example of the well system 10 and method is depicted. In this example, axial vibration is imparted to the tubular string 12 at the surface by periodically varying a flow rate 82 of fluid 80 pumped into the tubular string. Periodic varying of fluid drag in the tubular string 12 produces the axial vibration of the tubular string.

As depicted in FIG. 10, a pump 84 pumps the fluid 80 into flow paths 86, 88 which are connected in parallel. An adjustable choke 90 is connected in the flow path 86, and a time-varying flow restrictor 92 is connected in the flow path 88.

The choke 90 can be used to vary proportions of the fluid 80 that flows through the different flow paths 86, 88. For example, a greater restriction to flow through the choke 90 will cause a greater proportion of the fluid 80 to flow through the flow path 88, and the time-varying flow restrictor 92 will thereby have a greater influence on the flow rate 82. A lesser restriction to flow through the choke 90 will cause a greater proportion of the fluid 80 to flow through the flow path 86, and the time-varying flow restrictor 92 will thereby have less influence on the flow rate 82.

The time-varying flow restrictor 92 produces fluctuating, periodic changes in the flow rate 82. Operation of the flow restrictor 92 can be controlled by the control system 44 to produce desired axial vibrations of the tubular string 12. In some examples, the control system 44 may also be used to control operation of the choke 90.

Referring additionally now to FIG. 11, a representative schematic view of another example of the well system 10 and method is depicted. The FIG. 11 system 10 is similar to the FIG. 10 system, but the time-varying flow restrictor 92 is not used in the FIG. 11 system. Instead, a second pump 94 is connected to the flow path 88.

The pump 94 is operated in a manner such that additional fluid 96 is added to the flow path 88 periodically, thereby causing corresponding changes to the flow rate 82. In other examples, the fluid 96 could be periodically withdrawn from the flow path 88, or alternately added to and withdrawn from the flow path 88, by the pump 94. Operation of the pump 94 can be controlled by the control system 44 to produce the desired axial vibrations of the tubular string 12.

Referring additionally now to FIG. 12, a representative schematic view of another example of the well system 10 and method is depicted. In this example, the parallel flow paths 86, 88 are not used. Instead, the pump 84 is used to pump the fluid 80 into a flow path 98 connected to the tubular string 12.

Similar to the pump 94 in the FIG. 11 system 10, the pump 84 in the FIG. 12 system is operated in a manner such that the fluid 80 is pumped into the flow path 98 with periodic variations, thereby causing corresponding changes to the flow rate 82. Operation of the pump 84 can be controlled by the control system 44 to produce the desired axial vibrations of the tubular string 12.

Referring additionally now to FIG. 13, a representative partially cross-sectional view of another example of the well system 10 and method is depicted. In this example, a vibration enhancing tool 100 is connected between the blowout preventer stack 22 and the lubricator 24. In other examples, the vibration enhancing tool 100 could be connected between the injector assembly 20 and the blowout preventer stack 22, or in other positions, depending on a configuration of the surface equipment 38 or other factors.

The vibration enhancing tool 100 provides for mechanical compliance between the injector assembly 20 and the wellhead 26. In this manner, the injector assembly 20 can vibrate axially relative to the wellhead 26, for example, when the tubular string 12 is axially vibrated due to the flow rate 82 fluctuations produced in the FIGS. 10-12 examples. The vibration enhancing tool 100 can be "tuned" or adjusted as desired to thereby dampen or amplify the axial vibrations.

Referring additionally now to FIG. 14, a representative cross-sectional view of an example of the vibration enhancing tool 100 is depicted. In this example, the vibration enhancing tool 100 includes an inner mandrel 102 slidingly and sealingly received in an outer housing 104.

A radially enlarged piston 106 is formed on the inner mandrel 102. Annular chambers 108, 110 are formed radially between the inner mandrel 102 and the outer housing 104 on opposite sides of the piston 106.

Ports 112, 114 in communication with the respective chambers 108, 110 can be connected to a source of hydraulic pressure (such as, the FIG. 2 prime mover 41), and the hydraulic pressure applied to each chamber can be controlled by the control system 44. A proximity or position sensor 76 can be used to detect a position of the piston 106, and can be connected to the control system 44 for controlling operation of the vibration enhancing tool 100.

Springs 116, 118 in the respective chambers 108, 110 apply opposing biasing forces to the piston 106. The springs 116, 118 can be selected to have desired spring rates (and possibly preloads) to support expected loads to be applied to the tool 100. For example, the spring 118 may have a greater spring rate and/or preload if it is expected that a greater compressive load will be applied to the tool 100 in operation. The spring rates and/or preloads of the springs 116, 118 may be selected to effectively "center" the piston 106 in the chambers 108, 110 in operation.

The pressures applied to the chambers 108, 110 can be varied to "center" the piston 106 in operation instead of, or in addition to, using different spring rates or preloads of the springs 116, 118. In addition, the pressures in the chambers 108, 110 can be adjusted to compensate for loads applied to the tool 100, for example, so that the piston 106 is "centered" in the chambers 108, 110 while the tool amplifies or dampens axial vibration of the injector assembly 20 and the tubular string 12.

The vibration enhancing tool 100 can be "tuned" or adjusted as desired to thereby dampen or amplify the axial vibrations of the tubular string 12 by adjusting the pressures applied to the chambers 108, 110. The control system 44 can be used to control the application of the pressures to the chambers 108, 110 and thereby control the axial vibration of the injector assembly 20 and the tubular string 12.

Referring additionally now to FIG. 15, a representative cross-sectional and schematic view of another example of the vibration enhancing tool 100 is depicted. The FIG. 15 example is similar to the FIG. 14 example, except that the springs 116, 118 are not used in the FIG. 15 example.

Instead, accumulators 120, 122 are connected to the respective ports 112, 114. The accumulators 120, 122 as depicted in FIG. 15 are gas-over-liquid accumulators, but other types of accumulators may be used in other examples.

As in the FIG. 14 example, the pressures applied in the chambers 108, 110 via the accumulators 120, 122 in the FIG. 15 example can be adjusted to compensate for loads applied to the vibration enhancing tool 100 in operation, to "center" the piston 106, and/or to amplify or dampen the axial vibrations of the injector assembly 20 and the tubular string 12. The control system 44 can be used to control the application of the pressures to the chambers 108, 110 and the accumulators 120, 122.

Figure 16:
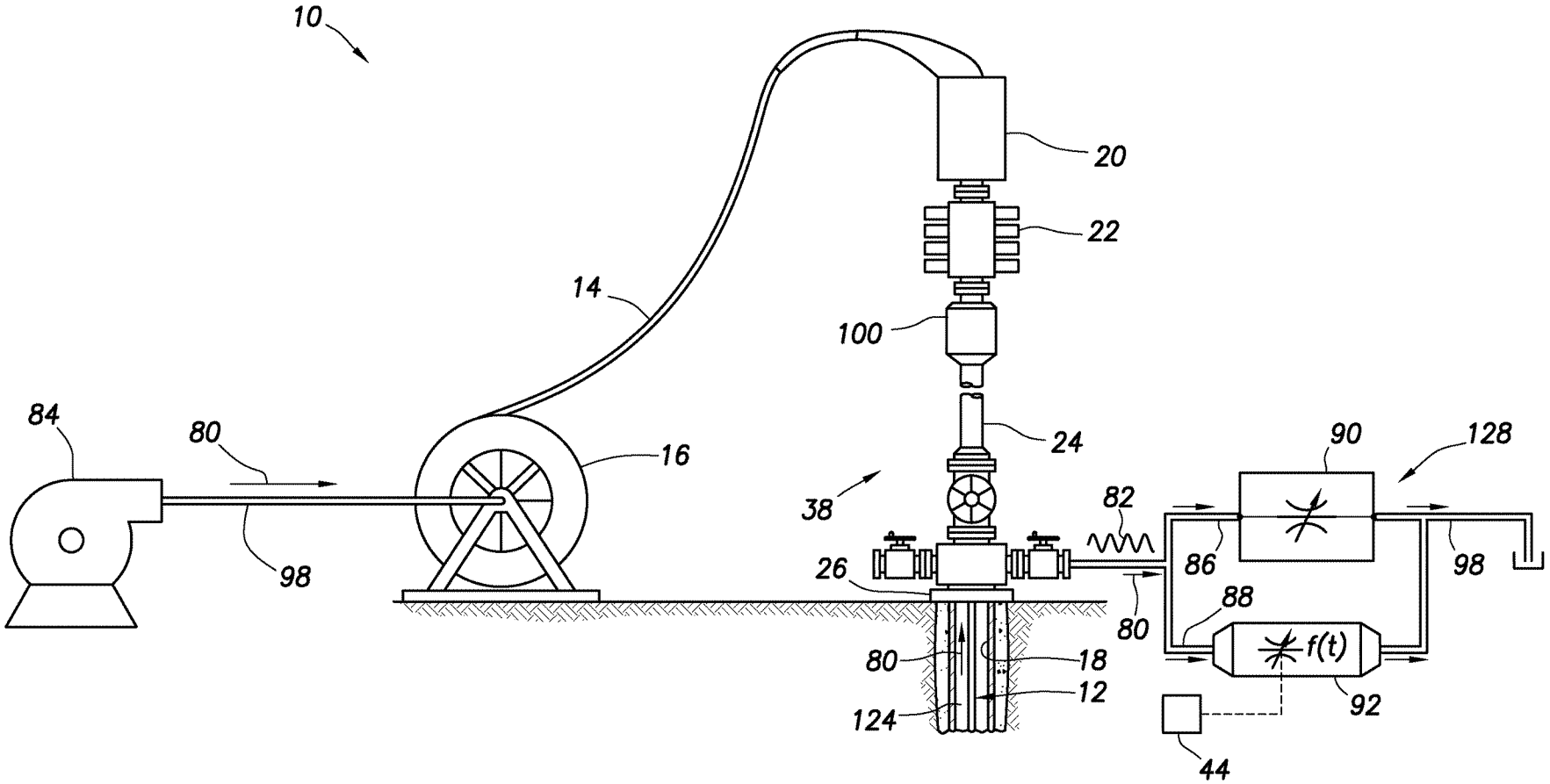
FIG. 16 is a representative partially cross-sectional view of another example of the well system and method.

Referring additionally now to FIG. 16, a representative partially cross-sectional view of another example of the well system 10 and method is depicted. The FIG. 16 example is similar in many respects to the FIG. 10 example. However, in the FIG. 16 example, the choke 90 and time-varying flow restrictor 92 are connected downstream of the wellhead 26.

The fluid 80 is pumped into the tubular string 12 by the pump 84. The fluid 80 exits the tubular string 12 into the wellbore 18 and returns to the surface via an annulus 124 formed radially between the tubular string and the wellbore. The fluid 80 flows from the annulus 124 to the flow paths 86, 88 via the wellhead 26.

The time-varying flow restrictor 92 is operated using the control system 44 to produce fluctuating, periodic changes in the flow rate 82. Operation of the flow restrictor 92 can be controlled by the control system 44 to reduce friction between the tubular string 12 and the wellbore 18. The control system 44 may also be used to control operation of the choke 90.

Figure 17:
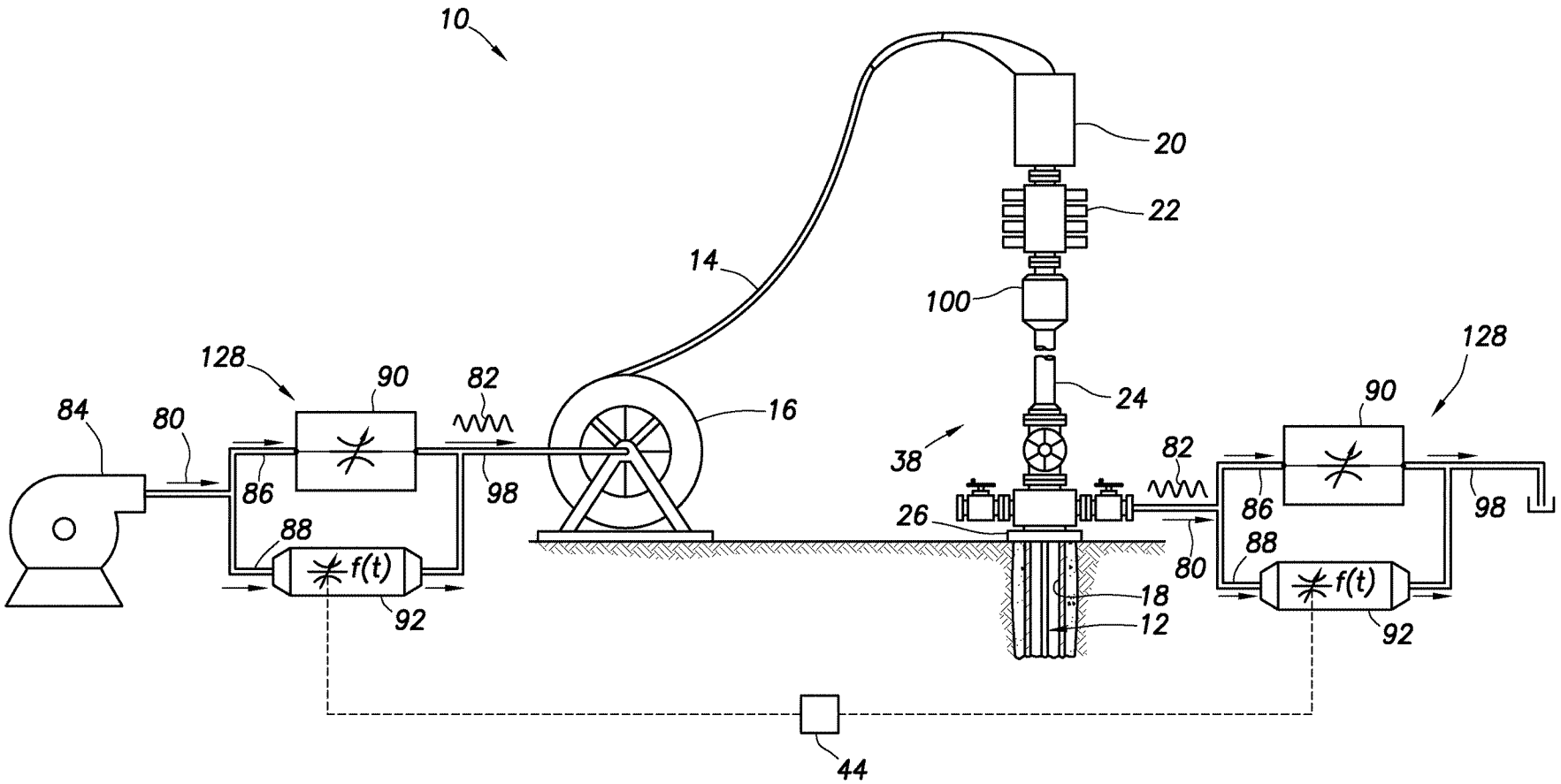
FIG. 17 is a representative partially cross-sectional view of another example of the well system and method.

Referring additionally now to FIG. 17, a representative partially cross-sectional view of another example of the well system 10 and method is depicted. The FIG. 17 example combines features of the FIGS. 10 & 16 examples, in that fluctuating, periodic changes in the flow rate 82 are produced both at the input to the tubular string 12 (using the choke 90 and time-varying flow restrictor 92 controlled by the control system 44), and in the return flow of the fluid 80 from the wellhead 26 (using another set of the choke 90 and the time-varying flow restrictor 92 controlled by the control system 44).

The FIG. 17 example demonstrates that various combinations of the features of the well system 10 and method examples described herein can be made, in keeping with the principles of this disclosure. Any of the features of any of the FIGS. 1-19 examples can be combined with any of the other examples to produce desirable results.

For example, the flow paths 86, 88, choke 90 and time-varying flow restrictor 92, comprising a flow modulation system 128 controllable by the control system 44, can be connected at the input side of the tubular string 12 in any of the FIGS. 1-19 examples, and/or can be connected at the downstream side of the wellhead 26. Similarly, the pump 84 may be operated by the control system 44 to produce the fluctuating flow rate 82 at the input side of the tubular string 12 (as in the FIG. 12 example) in any of the FIGS. 1-19 examples, and/or can be connected at the downstream side of the wellhead 26. A second pump 94 may be operated by the control system 44 to produce the fluctuating flow rate 82 at the input side of the tubular string 12 (as in the FIG. 11 example) in any of the FIGS. 1-19 examples, and/or can be connected at the downstream side of the wellhead 26. Thus a variety of different flow modulating systems 128 may be used in any of the examples described herein to produce the fluctuating flow rate 82.

Figure 18:
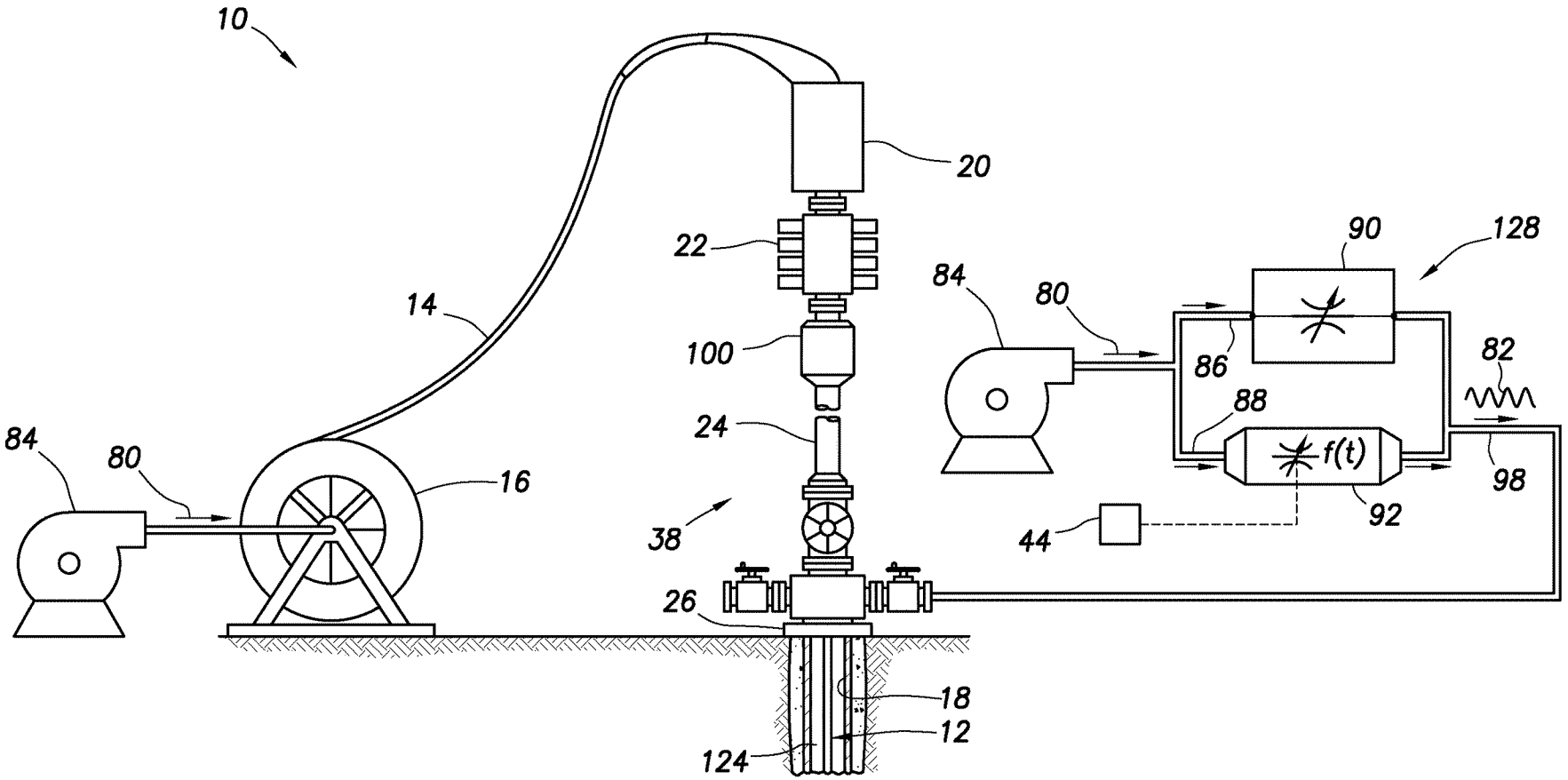
FIG. 18 is a representative partially cross-sectional view of another example of the well system and method.

Referring additionally now to FIG. 18, a representative partially cross-sectional view of another example of the well system 10 and method is representatively illustrated. In the FIG. 18 example, a pump 84 is used to pump fluid 80 into the annulus 124 via the wellhead 26, with the flow modulation system 128 (comprising the flow paths 86, 88, choke 90 and time-varying flow restrictor 92 in this example) being connected between the pump and the wellhead.

The control system 44 controls operation of the time-varying flow restrictor 92 to produce the fluctuating flow rate 82 of the fluid 80 into the annulus 124. Alternatively, the pump 84 may be operated by the control system 44 to produce the fluctuating flow rate 82 (as in the FIG. 12 example) into the annulus 124.

As depicted in FIG. 18, at the input side of the tubular string 12, the same or a different pump 84 pumps the fluid 80 into the tubular string. The fluid 80 pumped into the tubular string 12 may be the same as, or different from, the fluid pumped into the annulus 124. In some examples, another flow modulation system 128 may be connected between the pump 84 and the input side of the tubular sting 12, or the pump may be operated by the control system 44 to produce the fluctuating flow rate 82 at the input side of the tubular string (as in the FIG. 12 example).

Figure 19:
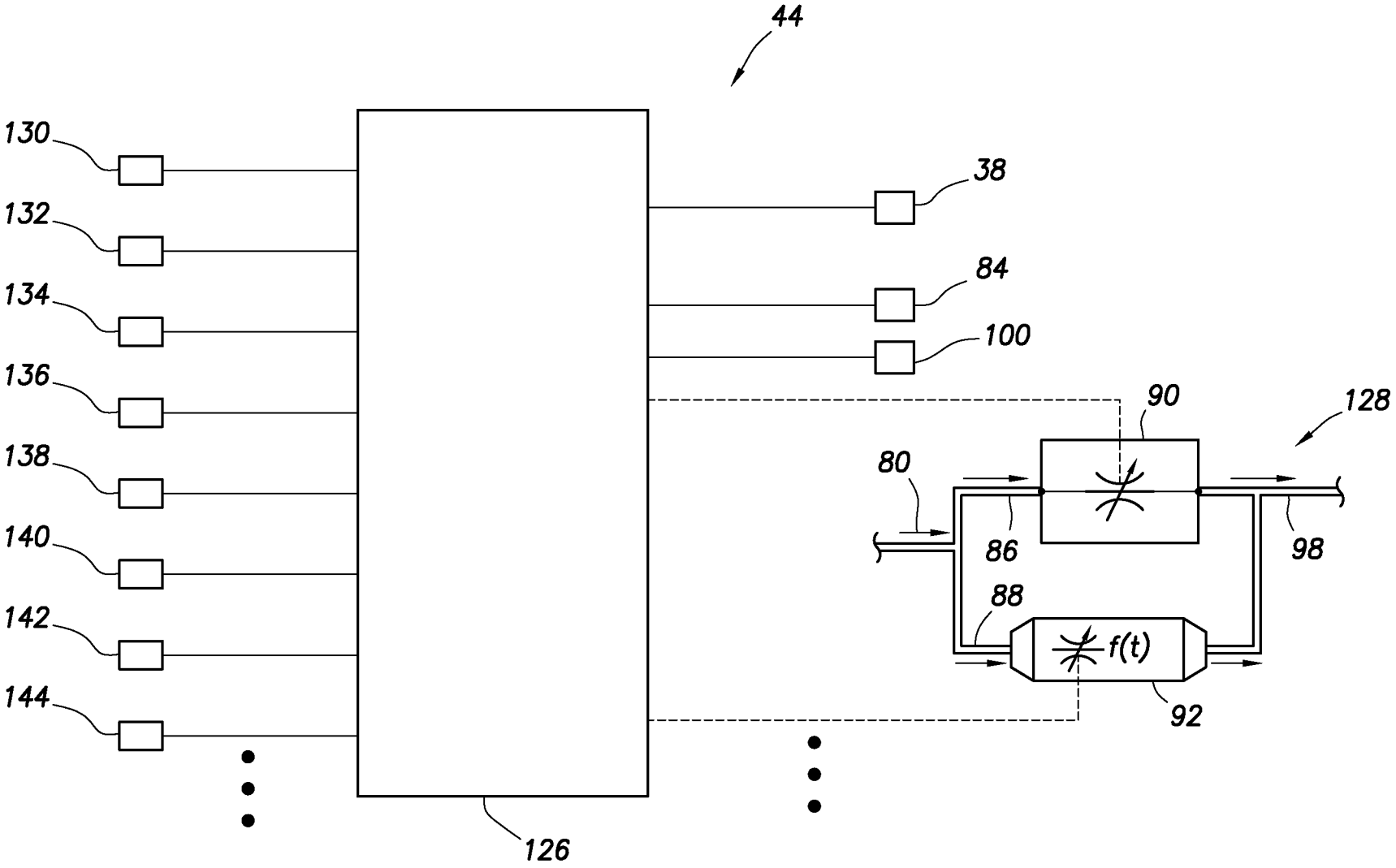
FIG. 19 is a representative schematic view of an example of a control system of the well system and method.

Referring additionally now to FIG. 19, a representative schematic view of an example of the control system 44 of the well system 10 and method is depicted. The FIG. 19 control system 44 may be used in any of the well system 10 and method examples of FIGS. 1-18. In the FIG. 19 example, the control system 44 includes a controller 126 (such as, comprising a programmable logic controller) capable of controlling operation of various components of the well system 10 (such as, the surface equipment 38, the pump 84, the choke 90, the time-varying flow restrictor 92, the vibration enhancing tool 100, etc.), in response to receiving outputs of various sensors 130, 132, 134, 136, 138, 140, 142, 144.

In the FIG. 19 example, the sensor 130 is an accelerometer for measuring an acceleration of the tubular string 12, the sensor 132 is a flowmeter for measuring the flow rate 82, the sensor 134 measures a rate of penetration or displacement of the tubular string, the sensor 136 is an accelerometer for measuring an acceleration of the surface equipment 38 connected above the wellhead 26, the sensor 138 is an accelerometer for measuring an acceleration of the injector 20, the sensor 140 measures a frequency of fluctuations produced in acceleration, pressure or flow rate in any of the components of the well system 10, the sensor 142 measures an amplitude of the fluctuations produced in acceleration, pressure or flow rate, and the sensor 144 is a pressure sensor for measuring fluid pressure in any of the components of the well system. Other sensors, additional or different sensors, and various combinations of sensors may be used in other examples.

The controller 126 can include input and output devices (such as, a monitor, a joystick, a keyboard, a pointing device, a data port, etc.), permanent and volatile memory, processors, software, instructions, data, etc., to enable the controller to effectively control operation of the various components of the well system 10. The controller 126 can be intelligent and adaptable to achieve certain specified objectives. For example, the controller 126 can comprise artificial intelligence, neural networks, genetic algorithms, etc., that enable the controller to adapt to changing conditions during a well operation.

In various examples, the controller 126 may be designed to control operation of the surface equipment 38, the pump 84, the choke 90 and/or the time-varying flow restrictor 92, so that a rate of penetration or displacement of the tubular string 12 in the wellbore 18 is maximized, or so that acceleration of the tubular string 12 is maximized. In some examples, multiple objectives (maximizing or optimizing rate of penetration, maximizing or optimizing tubular string 12 acceleration, minimizing or optimizing pressure differential between the tubular string input side and the wellhead 26 output side, etc.) can be pursued at the same time.

The controller 126 in this example is adaptive, in that the controller can receive outputs of multiple sensors 130, 132, 134, 136, 138, 140, 142, 144 indicating current conditions during a well operation, and automatically optimize the operation of the system 10 (for example, by maximizing or optimizing selected performance parameter(s) such as rate of penetration, vibration frequency or amplitude, acceleration of the tubular string 12, etc.) during the well operation. Thus, the selected performance parameter(s) is/are optimized continuously (or at predetermined intervals or intermittently) during a well operation.

The controller 126 can control operation of both of the choke 90 and the time-varying flow restrictor 92 during a well operation. The choke 90 can be operated to adjust gross flow rate through the flow modulation system 128. The time-varying flow restrictor 92 can be operated to create an oscillating frequency which vibrates the tubular string 12 (for example, matching a frequency of the flow rate 82 fluctuations with a resonant frequency of the tubular string to maximize acceleration of the tubular string).

It may now be fully appreciated that the above disclosure provides significant benefits to the art of displacing tubular strings in wellbores. In some examples described herein, the tubular string 12 can be axially vibrated at a surface location in addition to, or as an alternative to, use of a downhole vibration tool 36 connected in a bottom hole assembly 28 of the tubular string. The examples described herein may be used to reduce friction between the tubular string 12 and the wellbore 18, for example, to displace the tubular string in the wellbore, to retrieve a stuck tubular string, to reduce differential sticking, or for any other purpose.

The above disclosure provides to the art a system 10 for use with a subterranean well. In one example, the system 10 comprises a tubular string 12 deployed in the well, and an injector assembly 20 that axially vibrates the tubular string 12 at a surface location.

The injector assembly 20 may axially vibrate the tubular string 12 as the injector assembly 20 displaces the tubular string 12 in a wellbore 18 of the well.

The injector assembly 20 may comprise an injector chain assembly 42 including multiple motors 46 for driving respective multiple chains 48. The system 10 may include a control system 44 which varies a hydraulic or electrical input to the motors 46 to thereby axially vibrate the tubular string 12.

The tubular string 12 may comprise a vibration tool 36. The tubular string 12 may comprise continuous coiled tubing 14 and/or jointed pipe.

Also provided to the art by the above disclosure is a system 10 comprising a tubular string 12 deployed in a wellbore 18 of a well, an injector assembly 20 configured to displace the tubular string 12 in the wellbore 18, and a vibration tool 60 configured to vibrate the injector assembly 20.

The vibration tool 60 may be connected between the injector assembly 20 and a wellhead 26 of the well. The vibration tool 60 may be connected between the injector assembly 20 and a support structure 40 that suspends the injector assembly 20 above a wellhead 26 of the well.

The vibration tool 60 may be configured to vibrate the injector assembly 20 as the injector assembly 20 displaces the tubular string 12 in the wellbore 18. The vibration tool 60 may be configured to periodically vary a distance D between the injector assembly 20 and a wellhead 26 of the well.

The vibration tool 60 may be configured to vibrate the injector assembly 20 while an injector chain assembly 42 of the injector assembly 20 grips the tubular string 12. The vibration tool 60 may be configured to axially vibrate the tubular string 12 as the vibration tool 60 vibrates the injector assembly 20.

The above disclosure also provides to the art a system 10 comprising a tubular string 12 deployed in a wellbore 18 of a well, and a first pump 84 connected to the tubular string 12. A flow rate 82 of fluid 80 pumped into the tubular string 12 at a surface location is periodically varied to thereby produce axial vibration of the tubular string 12.

The first pump 84 may pump the fluid 80 through first and second flow paths 86, 88 connected in parallel. A time-varying flow restrictor 92 may be connected in the second flow path 88. A control system 44 may control operation of the time-varying flow restrictor 92.

The first pump 84 may pump the fluid 80 through first and second flow paths 86, 88 connected in parallel. A second pump 94 may be connected to the second flow path 88. A control system 44 may control operation of the second pump 94.

An output of the first pump 84 may be periodically varied to thereby vary the flow rate 82 of the fluid 80 into the tubular string 12. A control system 44 may control operation of the first pump 84.

The system 10 may include a vibration enhancing tool 100 connected between an injector assembly 20 and a wellhead 26 of the well. The vibration enhancing tool 100 may amplify and/or dampen the axial vibration of the tubular string 12. A control system 44 may control operation of the vibration enhancing tool 100.

A system 10 for use with a subterranean well is described herein. In one example, the system 10 can comprise: a tubular string 12 deployed in a wellbore 18 of the well, and a first flow modulation system 128 at a surface location, the first flow modulation system 128 configured to receive fluid 80 returned from the wellbore 18, and the first flow modulation system 128 further configured to periodically vary a flow rate 82 of the fluid 80 returned from the wellbore 18.

The first flow modulation system 128 may include first and second flow paths 86, 88 connected in parallel. A time-varying flow restrictor 92 may be connected in the second flow path 88.

A control system 44 may be configured to control operation of the time-varying flow restrictor 92. The control system 44 may be further configured to vary the flow rate 82 of the fluid 80 in response to an output of a sensor 130 that measures an acceleration of the tubular string 12.

The control system 44 may be configured to vary the flow rate 82 of the fluid 80 in response to an output of a sensor 134 that measures a rate of penetration of the tubular string 12. The control system 44 may be configured to control operation of a choke 90 connected in the first flow path 86.

The system 10 may include a second flow modulation system 128 at the surface location, the second flow modulation system 128 configured to periodically vary a flow rate 82 of the fluid 80 pumped into the tubular string 12.

The second flow modulation system 128 may include first and second flow paths 86, 88 connected in parallel, and a time-varying flow restrictor 92 connected in the second flow path 88.

A control system 44 may be configured to control operation of the time-varying flow restrictor 92. The control system 44 may be further configured to vary the flow rate 82 of the fluid 80 in response to an output of a sensor 130 that measures an acceleration of the tubular string 12.

The control system 44 may be configured to vary the flow rate 82 of the fluid 80 in response to an output of a sensor 134 that measures a rate of penetration of the tubular string 12. The control system 44 may be configured to control operation of a choke 90 connected in the first flow path 86.

A method of advancing a tubular string 12 in a subterranean well is described herein. In one example, the method can comprise: pumping fluid 80 through the tubular string 12 and into a wellbore 18 of the well; returning the fluid 80 to a surface location; and flowing the returned fluid 80 through a first time-varying flow restrictor 92 at the surface location, thereby producing fluctuations in a flow rate 82 of the returned fluid 80.

The flowing step may include vibrating the tubular string 12 in response to the fluctuations in the flow rate 82. The flowing step may be performed as the tubular string 12 is displaced in the wellbore 18.

The flowing step may include flowing the fluid 80 through first and second flow paths 86, 88 that are connected in parallel. The first time-varying flow restrictor 92 may be connected in the second flow path 88.

A control system 44 may control operation of the first time-varying flow restrictor 92. The control system 44 may further control operation of the first time-varying flow restrictor 92 in response to an output of a sensor 130 that measures acceleration of the tubular string 12.

The control system 44 may vary the flow rate 82 of the fluid 80 in response to an output of a sensor 134 that measures a rate of penetration of the tubular string 12. The control system 44 may control operation of a choke 90 connected in the first flow path 86.

The pumping step may include producing fluctuations in a flow rate 82 of the fluid 80 pumped through the tubular string 12. The pumping may further include pumping the fluid 80 through a second time-varying flow restrictor 92 at the surface location, thereby producing the fluctuations in the flow rate 82 of the fluid 80 pumped through the tubular string 12.

The pumping step may further include pumping the fluid 80 through first and second flow paths 86, 88 that are connected in parallel. The second time-varying flow restrictor 92 may be connected in the second flow path 88.

A control system 44 may control operation of the second time-varying flow restrictor 92. The control system 44 may further control operation of the second time-varying flow restrictor 92 in response to an output of a sensor 130 that measures acceleration of the tubular string 12.

The control system 44 may vary the flow rate 82 of the fluid 80 in response to an output of a sensor 134 that measures a rate of penetration of the tubular string 12. The control system 44 may control operation of a choke 90 connected in the first flow path 86.

The method may include connecting a vibration tool 36 in the tubular string 12, deploying the tubular string 12 with the vibration tool 36 into the wellbore 18, and operating the vibration tool 36 in the well.

The method may include cutting through a plug 30 in the wellbore 18 while the tubular string 12 is vibrated.

The method may include intermittently producing the fluctuations while the tubular string 12 is deployed into the well.

The step of producing the fluctuations may be commenced only after the tubular string 12 is deployed a predetermined distance into the well.

The step of producing the fluctuations may be commenced only after a displacement speed of the tubular string 12 in the well is less than a predetermined level.

A system 10 is disclosed herein for use with a subterranean well. In one example, the system 10 can comprise: a tubular string 12 deployed in a wellbore 18 of the well, and a first pump 84 connected to an annulus 124 surrounding the tubular string 12 in the well. A flow rate 82 of fluid 80 pumped into the annulus 124 at a surface location by the first pump 84 is varied to thereby produce vibration of the tubular string 12.

The first pump 84 may pump the fluid 80 through first and second flow paths 86, 88 connected in parallel. A time-varying flow restrictor 92 may be connected in the second flow path 88.

A control system 44 may control operation of the time-varying flow restrictor 92. The control system 44 may control operation of the time-varying flow restrictor 92 in response to an output of a sensor 130 that measures acceleration of the tubular string 12.

The control system 44 may be configured to vary the flow rate 82 of the fluid 80 in response to an output of a sensor 134 that measures a rate of penetration of the tubular string 12. The control system 44 may be configured to control operation of a choke 90 connected in the first flow path 86.

The tubular string 12 may include a vibration tool 36. The tubular string may include continuous coiled tubing 14. The tubular string 12 may include jointed pipe.

The system 10 may include a second pump 84 connected to the tubular string 12 and configured to pump fluid 80 into the tubular string 12.

A method of advancing a tubular string 12 in a subterranean well is disclosed herein. In one example, the method can comprise: pumping fluid 80 into an annulus 124 in the well surrounding the tubular string 12; and varying a flow rate 82 of the fluid 80 pumped into the annulus 124 as the tubular string 12 is advanced in the well, thereby vibrating the tubular string 12.

The flow rate varying may include flowing the fluid 80 through first and second flow paths 86, 88 that are connected in parallel. The flowing step may include flowing the fluid 80 through a time-varying flow restrictor 92 connected in the second flow path 88.

A control system 44 may control operation of the time-varying flow restrictor 92. The control system 44 may control operation of the time-varying flow restrictor 92 in response to an output of a sensor 130 that measures acceleration of the tubular string 12.

The control system 44 may vary the flow rate 82 of the fluid 80 in response to an output of a sensor 134 that measures a rate of penetration of the tubular string 12. The control system 44 may control operation of a choke 90 connected in the first flow path 86.

The method may include connecting a vibration tool 36 in the tubular string 12, deploying the tubular string 12 with the vibration tool 36 into the well, and operating the vibration tool 36 in the well. The method may include cutting through a plug 30 in the well while the tubular string 12 is vibrated.

The method may include intermittently performing the vibrating while the tubular string 12 is deployed into the well. The vibrating may be commenced only after the tubular string 12 is deployed a predetermined distance into the well. The vibrating may be commenced only after a displacement speed of the tubular string 12 in the well is less than a predetermined level.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising:

a tubular string deployed in a wellbore of the well, in which a fluid is pumped into the tubular string, and in which the fluid returns from the wellbore to a surface location; and a first flow modulation system at the surface location, the first flow modulation system configured to receive the fluid returned from the wellbore, and the first flow modulation system further configured to periodically vary a flow rate of the fluid returned from the wellbore in response to levels of at least one of acceleration of the tubular string and rate of penetration of the tubular string.

2. The system of claim 1, in which the first flow modulation system comprises first and second flow paths connected in parallel, and in which a time-varying flow restrictor is connected in the second flow path.

3. The system of claim 2, in which a control system is configured to control operation of the time-varying flow restrictor.

4. The system of claim 3, in which the control system is further configured to vary the flow rate of the fluid in response to an output of a sensor that measures the acceleration of the tubular string.

5. The system of claim 3, in which the control system is further configured to vary the flow rate of the fluid in response to an output of a sensor that measures the rate of penetration of the tubular string.

6. The system of claim 3, in which the control system is further configured to control operation of a choke connected in the first flow path.

7. The system of claim 1, in which the tubular string comprises continuous coiled tubing.

8. The system of claim 1, in which the tubular string comprises jointed pipe.

9. The system of claim 1, further comprising a second flow modulation system at the surface location, the second flow modulation system configured to periodically vary a flow rate of the fluid pumped into the tubular string.

10. The system of claim 9, in which the second flow modulation system comprises first and second flow paths connected in parallel, and in which a time-varying flow restrictor is connected in the second flow path.

11. The system of claim 10, in which a control system is configured to control operation of the time-varying flow restrictor.

12. The system of claim 11, in which the control system is further configured to vary the flow rate of the fluid in response to an output of a sensor that measures the acceleration of the tubular string.

13. The system of claim 11, in which the control system is further configured to vary the flow rate of the fluid in response to an output of a sensor that measures the rate of penetration of the tubular string.

14. The system of claim 11, in which the control system is further configured to control operation of a choke connected in the first flow path.

15. A method of advancing a tubular string in a subterranean well, the method comprising:

pumping fluid through the tubular string and into a wellbore of the well;

returning the fluid to a surface location; and flowing the returned fluid through a first time-varying flow restrictor at the surface location, thereby producing fluctuations in a flow rate of the returned fluid, in which the flow rate of the returned fluid is varied in response to levels of at least one of acceleration of the tubular string and rate of penetration of the tubular string.

16. The method of claim 15, in which the flowing comprises vibrating the tubular string in response to the fluctuations in the flow rate.

17. The method of claim 15, in which the flowing is performed as the tubular string is displaced in the wellbore.

18. The method of claim 15, in which the flowing comprises flowing the fluid through first and second flow paths that are connected in parallel.

19. The method of claim 18, in which the first time-varying flow restrictor is connected in the second flow path.

20. The method of claim 15, in which a control system controls operation of the first time-varying flow restrictor.

21. The method of claim 20, in which the control system further controls operation of the first time-varying flow restrictor in response to an output of a sensor that measures the acceleration of the tubular string.

22. The method of claim 20, in which the control system further controls operation of the first time-varying flow restrictor in response to an output of a sensor that measures the rate of penetration of the tubular string.

23. The method of claim 20, in which the control system further controls operation of a choke connected in the first flow path.

24. The method of claim 15, in which the pumping comprises producing fluctuations in a flow rate of the fluid pumped through the tubular string.

25. The method of claim 24, in which the pumping further comprises pumping the fluid through a second time-varying flow restrictor at the surface location, thereby producing the fluctuations in the flow rate of the fluid pumped through the tubular string.

26. The method of claim 25, in which the pumping further comprises pumping the fluid through first and second flow paths that are connected in parallel.

27. The method of claim 26, in which the second time-varying flow restrictor is connected in the second flow path.

28. The method of claim 25, in which a control system controls operation of the second time-varying flow restrictor.

29. The method of claim 28, in which the control system further controls operation of the second time-varying flow restrictor in response to an output of a sensor that measures the acceleration of the tubular string.

30. The method of claim 28, in which the control system further controls operation of the second time-varying flow restrictor in response to an output of a sensor that measures the rate of penetration of the tubular string.

31. The method of claim 28, in which the control system further controls operation of a choke connected in the first flow path.

32. The method of claim 15, in which the tubular string comprises jointed pipe.

33. The method of claim 15, in which the tubular string comprises continuous coiled tubing.

34. The method of claim 15, further comprising connecting a vibration tool in the tubular string, deploying the tubular string with the vibration tool into the wellbore, and operating the vibration tool in the well.

35. The method of claim 15, further comprising cutting through a plug in the wellbore while the tubular string is vibrated.

36. The method of claim 15, further comprising intermittently producing the fluctuations while the tubular string is deployed into the well.

37. The method of claim 15, in which producing the fluctuations is commenced only after the tubular string is deployed a predetermined distance into the well.

38. The method of claim 15, in which producing the fluctuations is commenced only after a displacement speed of the tubular string in the well is less than a predetermined level.

* * * * *